US006778788B2

(12) United States Patent
Tomita et al.

(10) Patent No.: US 6,778,788 B2
(45) Date of Patent: Aug. 17, 2004

(54) FIXING APPARATUS AND METHOD FOR CONTROLLING AMOUNT OF HEAT PRODUCED BY HEATER IN ACCORDANCE WITH IMAGE INFORMATION

(75) Inventors: Kunihiko Tomita, Kanagawa-ken (JP); Koji Ozaki, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/933,153

(22) Filed: Aug. 21, 2001

(65) Prior Publication Data

US 2002/0031363 A1 Mar. 14, 2002

(30) Foreign Application Priority Data

| | | |
|---|---|---|
| Aug. 21, 2000 | (JP) | 2000-249839 |
| Sep. 11, 2000 | (JP) | 2000-274850 |
| Nov. 30, 2000 | (JP) | 2000-365159 |
| May 30, 2001 | (JP) | 2001-163025 |

(51) Int. Cl.[7] ..... G03G 15/20
(52) U.S. Cl. ..... 399/69; 399/329
(58) Field of Search ..... 399/335, 329, 399/320, 67, 69; 219/216, 469–471

(56) References Cited

U.S. PATENT DOCUMENTS

| | | | | |
|---|---|---|---|---|
| 4,998,121 A | * | 3/1991 | Koh et al. | 399/335 |
| 5,220,383 A | | 6/1993 | Enoki et al. | |
| 5,241,155 A | * | 8/1993 | Koh et al. | 219/216 |
| 5,245,391 A | | 9/1993 | Suzuki et al. | |
| 5,311,263 A | | 5/1994 | Suzuki et al. | |
| 5,339,141 A | | 8/1994 | Suzuki et al. | |
| 5,424,814 A | | 6/1995 | Suzuki et al. | |
| 5,450,172 A | | 9/1995 | Suzuki et al. | |
| 5,502,552 A | | 3/1996 | Iwata et al. | |
| 5,512,993 A | | 4/1996 | Endo et al. | |
| 5,527,657 A | | 6/1996 | Takeda et al. | |
| 5,541,029 A | | 7/1996 | Iwata et al. | |
| 5,557,392 A | | 9/1996 | Iwata | |
| 5,707,769 A | * | 1/1998 | Hagi et al. | |
| 5,809,386 A | | 9/1998 | Iwata | |
| 5,812,917 A | | 9/1998 | Iwata et al. | |
| 5,869,213 A | | 2/1999 | Iwata et al. | |
| 5,907,348 A | * | 5/1999 | Ogasawara et al. | 399/329 |
| 6,201,945 B1 | * | 3/2001 | Schlueter et al. | 399/329 |
| 6,370,350 B2 | | 4/2002 | Tomita | |
| 6,413,690 B2 | | 7/2002 | Tomita | |
| 6,423,941 B1 | * | 7/2002 | Kanari et al. | 219/216 |
| 6,455,217 B2 | | 9/2002 | Tomita | |
| 6,469,279 B1 | * | 10/2002 | Ohtsuka | 219/216 |
| 6,492,084 B2 | | 12/2002 | Tomita | |

FOREIGN PATENT DOCUMENTS

| | | | | |
|---|---|---|---|---|
| JP | 51-29825 | | 8/1976 | |
| JP | 2516886 | | 12/1988 | |
| JP | 4-114184 | | 4/1992 | |
| JP | 0533728 A | * | 12/1993 | G03G/15/20 |
| JP | 6-202507 | * | 7/1994 | |
| JP | 08-83015 | * | 3/1996 | |

OTHER PUBLICATIONS

U.S. patent application Ser. No. 10/680,091, filed Oct. 8, 2003, Omata et al.

* cited by examiner

*Primary Examiner*—Susan Lee
(74) *Attorney, Agent, or Firm*—Oblon, Spivak, McClelland, Maier & Neustadt, P.C.

(57) ABSTRACT

A fixing apparatus includes a beater, an endless belt, a pressure roller, and a heater controller. The heater has a line shape orthogonal to a direction in which a recording sheet carrying an unfixed toner image formed with toner in accordance with image information is transferred. The endless belt is rotated with an inner surface thereof sliding over a surface of the heater. The pressure roller is arranged at a position opposite to the heater relative to the endless belt and is held for rotation in contact with the endless belt under pressure to form a nip therebetween. The heater controller energizes the heater in accordance with the image information.

75 Claims, 13 Drawing Sheets

FIXING APPARATUS AND METHOD FOR CONTROLLING AMOUNT OF HEAT PRODUCED BY HEATER IN ACCORDANCE WITH IMAGE INFORMATION

BACKGROUND OF THE INVENTION

1. Field of the Invention

The present invention relates to a method and apparatus for image forming, and more particularly to a method and apparatus for image forming that is capable of performing an effective fixing process.

2. Description of the Related Art

Under an increasing demand for conservation of natural resources and saving energy in the scope of a global environment protection, considerable efforts in reducing consumption of electric power are made in the field of electrophotographic image forming apparatuses such as copying machines, facsimile machines, printers, plotters, and so on. Among various processes of image forming, a fixing process particularly consumes a great amount of electric power and a technique of a low temperature fixing is expedited in this field. To succeed in the low temperature fixing, it is necessarily needed to lower a softening or melting point of toner. A thermoplastic resin included in the toner has a character that lower the softening or melting point lower a melting viscosity. This character is based on a fact that the softening or melting point of a thermoplastic resin is determined by various factors such as molecular weight, distribution of molecular weight, the level of crystallization, the level of bridging, intermolecular force, and so forth. Therefore, in order to lower the softening or melting point of a thermoplastic resin without changing its structure, it is needed that the molecular weight or the level of bridging is reduced or that the distribution of molecular weight is narrowed. Since the distribution of molecular weight has a lower limitation which is determined by a storage limitation of the resin, it is narrowed when the molecular weight is reduced.

In general, when molecular weight is reduced, chains of molecules are shortened and the connections between the molecules are loosened. Therefore, the melting viscosity is lowered. Also, when the distribution of molecular weight is narrowed, the connections between the molecules are loosened and therefore the melting viscosity is lowered. Further, when the level of bridging between molecules is lowered, each molecule becomes easy to move and therefore the melting viscosity of the molecules is lowered.

For example, a published Japanese examined patent application No. 51-29825 (1976) describes a fixing method which performs a fixing process using toner that has a lowered melting viscosity, as described above, without causing an offset. The offset in the fixing process is a problematic phenomenon in which toner is undesirably deposited on a part of a fixing roller by loosing its character of cohesion when melted. The fixing of toner is performed when the toner is in a rubber state. That is, as a temperature rises, the toner resin begins to be softened and its viscosity is lowered. Then, the toner resin is brought to a state of rubber. As far as being in the rubber state, the toner resin maintains a relatively high cohesion and does not cause the offset problem.

A Japanese Patent, No. 2516886, describes an apparatus for heating an image using the above-mentioned technique. This apparatus includes a line-shaped heating member based on a heating member described in the above-mentioned published Japanese examined patent application, No. 51-29825 (1976), and is characterized by a feature in that the line-shaped heating member is energized with a pulse signal. This feature attempts to eliminate a residual heat needed for reduction of a standby time and to reduce emission of an extra amount of heat inside the apparatus.

The above-mentioned background techniques and apparatuses, however, may only be effective when the apparatus processes a small number of images or when the apparatus is almost out of busy state. When a large number of images are processed, the recording sheets take a great amount of heat. This causes a loss of a great amount of energy, regardless of whether a roller-shaped or line-shaped heating member is used.

However, in most cases, an image to be actually printed on a recording sheet has a substantial area in the range between 2% and 10% relative to a recording area in a recording sheet. This means that heat is taken also by a 90% to 98% area of a recording sheet without being used. For example, a text image that has lines of characters typically includes non-image spaces between the lines and the heat applied to these non-image spaces are not used.

Since the above-mentioned background techniques and apparatuses employ the toner having a relatively high softening or melting point, a partial application of heat to an image area in a recording sheet causes a fixing mechanism and a recording sheet to be regionally deformed. As a result, the recording sheet is transferred not in a properly straight manner or has wrinkles due to distortion.

SUMMARY OF THE INVENTION

The present application describes a novel fixing apparatus. In one example, a novel fixing apparatus includes a heater, an endless belt, a pressure roller, and a heater controller. The heater has a line shape orthogonal to a direction in which a recording sheet carrying an unfixed toner image formed with toner in accordance with image information is transferred. The endless belt is configured to be rotated with an inner surface thereof sliding over a surface of the heater. The pressure roller is arranged at a position opposite to the heater relative to the endless belt and is held for rotation in contact with the endless belt under pressure to form a nip therebetween. The heater controller is configured to energize the heater in accordance with the image information. In this novel fixing apparatus, when the recording sheet is brought to the nip with the unfixed toner image facing the endless belt, the pressure roller applies pressure to the recording sheet against the endless belt so that the unfixed toner image is fixed on the recording sheet with heat by the heater as the recording sheet is transferred by movement of the endless belt and the pressure roller.

The toner may include a resin as a main adhesive agent and has properties of a softening or melting point in a range between 50° C. and 160° C. and a viscosity in a range between 10 [c poise] and $10^{13}$ [c poise] under a temperature above the softening or melting point.

The heater may include at least two parallel heating elements, each of which has a line shape orthogonal to the direction in which the recording sheet is transferred.

The heater controller may alternately energize the above-mentioned at least two parallel heating elements with alternating pulses.

The above-mentioned at least two parallel heating elements may be distant from each other by 10 mm or less.

Each of the at least two parallel heating elements may have a width in a range between 0.01 mm and 5 mm.

The heater may include a plurality of heating elements arranged in line in a direction orthogonal to the direction in which the recording sheet is transferred.

Each of the plurality of heating elements may include a thermal head.

The heater controller may selectively energize the plurality of heating elements.

The above-mentioned fixing apparatus may further include a cooling mechanism configured to cool the toner image after the toner image is fixed with heat by the heater on the recording sheet.

The above-mentioned fixing apparatus may further include a guide roller arranged at a position downstream from the heater in the direction in which the recording sheet is transferred, the guide roller being configured to support the endless belt and to serve as a cooling mechanism configured to cool the toner image after the toner image is fixed with heat by the heater on the recording sheet.

The above-mentioned fixing apparatus may further include a mechanism configured to cause the endless belt to tightly hold the toner image and the recording sheet together until the toner image is fixed on the recording sheet after the toner image is subjected to the heat of the heater.

The heater controller may stop energizing the heater during a time when a non-image region between two adjacent toner image lines in the recording sheet is brought close to the heater.

The heater controller may energize the heater during a time when a region of the toner image in the recording sheet is brought close to the heater.

The heater controller may energize the heater with an electric power reduced by 5% or more during a time when a non-image region between two adjacent toner image lines in the recording sheet is brought close to the heater.

The present invention further provides a novel fixing method of image forming. In one example, a novel fixing method of image forming includes the steps of forming, proving, rotating, transferring and energizing. The forming step forms a nip between an endless belt and a pressure roller which are held for rotation in contact with each other under pressure. The proving step provides a heater at position inside the endless belt, in contact with the endless belt, and opposite to the pressure roller relative to the endless belt. The above-mentioned heater has a line shape orthogonal to a direction in which a recording sheet having an unfixed toner image formed with toner in accordance with image information is transferred. The rotating step rotates the endless belt and the pressure roller. In this case, the endless belt slides over a surface of the heater by rotation. The transferring step transfers the recording sheet to the nip. The recording sheet is in an orientation in which the toner image faces the endless belt. The energizing step energizes the heater in accordance with the image information when the toner image is brought to the heater.

The present invention further provides a novel image forming apparatus. In one example, a novel image forming apparatus includes an image forming mechanism, a heater, an endless belt, a pressure roller, and a heater controller. The image forming mechanism is configured to form a toner image with toner on a recording sheet in accordance with image information. The heater has a line shape orthogonal to a direction in which the recording sheet carrying an unfixed toner image formed by the image forming mechanism is transferred. The endless belt is configured to be rotated with an inner surface thereof sliding over a surface of the heater. The pressure roller is arranged at a position opposite to the heater relative to the endless belt and is held for rotation in contact with the endless belt under pressure to form a nip therebetween. The heater controller is configured to energize the heater in accordance with the image information. In the above-mentioned image forming apparatus, when the recording sheet is brought to the nip with the unfixed toner image facing the endless belt, the pressure roller applies pressure to the recording sheet against the endless belt so that the unfixed toner image is fixed on the recording sheet with heat by the heater as the recording sheet is transferred by movement of the endless belt and the pressure roller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
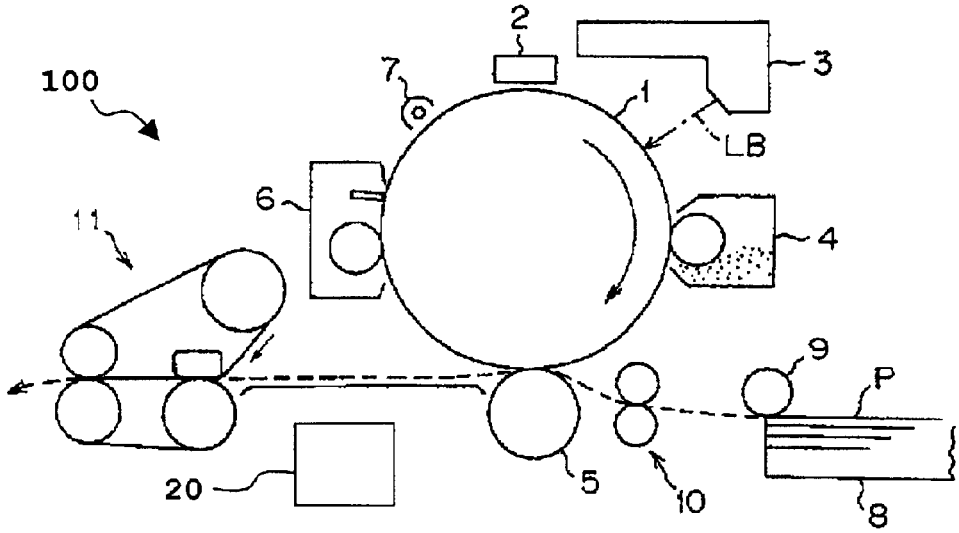
FIG. 1 is a schematic diagram of an image forming apparatus including a fixing apparatus according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, an image forming apparatus 100 according to an embodiment of the present invention is explained. FIG. 1 shows a main portion of the image forming apparatus 100 that performs an image forming operation in accordance with an electrophotographic method. As illustrated in FIG. 1, the image forming apparatus 100 includes a photoconductor 1, a charging unit 2, an optical writing unit 3, a development unit 4, a transfer unit 5, a cleaning unit 6, and a discharging unit 7. The photoconductor 1 is a photosensitive and photoconductive member, having a drum-like shape, and is mounted at the center among above-mentioned various components. The photoconductor 1 is rotated in a direction indicated by an arrow and serves as an image carrying member. The charging unit 2 performs a charging process in which the surface of the photoconductor 1 is evenly charged. The optical writing unit 3 emits a laser beam (LB) and controls it to write an electrostatic image on the surface of the photoconductor 1, which process is referred to as an optical writing process. The development unit 4 performs a development process for developing the electrostatic image into a visual image with toner. The transfer unit 5 performs a transfer process for transferring the toner image formed on the surface of the photoconductor 1 onto a recording sheet P. The cleaning unit 6 performs a cleaning process for cleaning residual toner and dust off the surface of the photoconductor 1. The discharging unit 7 performs a discharging process for discharging a remaining charge on the photoconductor 1.

The image forming apparatus 100 further includes a sheet cassette 8, a sheet feed roller 9, a pair of registration rollers 10, and a fixing unit 11. The sheet cassette 8 stores a plurality of recording sheets P. The sheet feed roller 9 picks up a recording sheet P from the sheet cassette 8 and transfers it towards the registration roller 10 that transfers the recording sheet P towards the photoconductor 1 in synchronism with a rotational movement of the photoconductor 1. The fixing unit 11 performs a fixing process for fixing the toner image on the recording sheet P after a completion of the transfer process. The recording sheet P is transferred through a sheet path arranged along a dotted-line with an arrow, as shown in FIG. 1.

The development unit 4 uses toner that includes resin as a main adhesive element and has a softening or melting point in a range between 50° C. and 160° C. and a viscosity in a range of from 10 [c poise] to $10^{13}$ [c poise] at a temperature above the softening or melting point.

Figure 2:
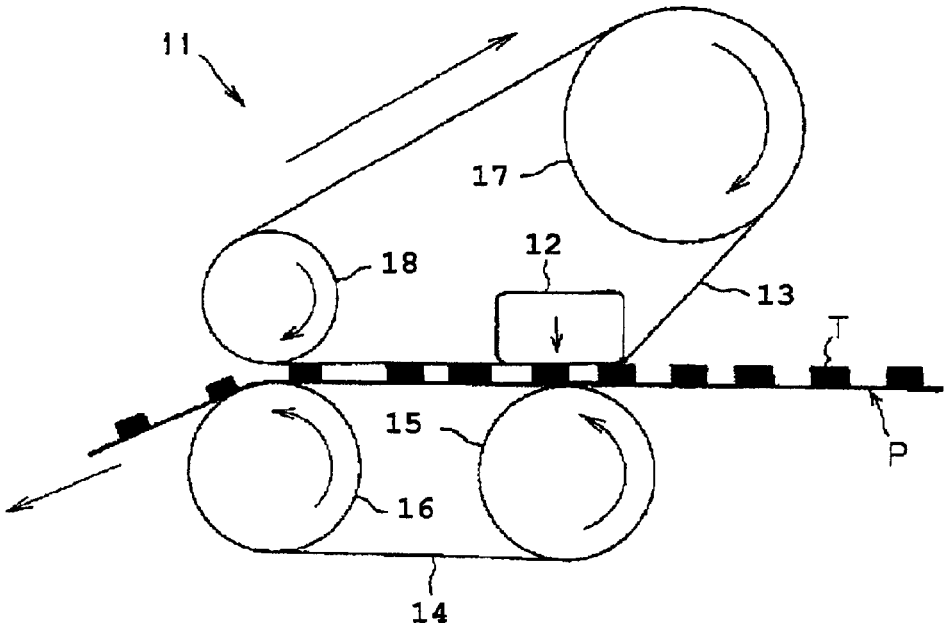
FIG. 2 is a schematic diagram of the fixing apparatus included in the image forming apparatus of FIG. 1.

As shown in FIG. 2, the fixing unit 11 includes a heater 12, endless belts 13 and 14, a pressure roller 15, and guide rollers 16–18. The heater 12 includes a line heating member, i.e., a thermal head or a heater, and is arranged in a way such that the longitudinal side thereof is orthogonal to a sheet transfer direction in which the recording sheet P is fed. The endless belt 13 is extended under pressure between the guide rollers 17 and 18 and contacts the heater 12. The endless belt 13 is rotated in a direction indicated by an arrow. The pressure roller 15 is disposed at a position facing the heater 12 via the endless belts 13 and 14. When the recording sheet P is present between the endless belts 13 and 14, the pressure roller 15 applies pressure to the recording sheet P against the heater 12 via the endless belts 13 and 14. The endless belt 14 is extended under pressure between the pressure roller 15 and the guide roller 16.

In the above-described fixing unit 11, a toner image T on the recording sheet P is heated by the heater 12 via the endless belt 13 when the recording sheet P is fed into the gap between the endless belts 13 and 14. After that, the recording sheet P is subjected to a cooling process by which the toner image T is firmly fixed to the recording sheet P and is then separated from the endless belt 14. At least one of the guide rollers 16 and 18, arranged downstream from the heater 12 in the sheet transfer direction, is made of metal having a relatively high thermal conductivity and serves as a driving roller and a cooling roller. After a completion of the heat fixing process, the toner image T, the recording sheet P, and the endless belt 13 are cooled by the guide rollers 16 and 18. The recording sheet P makes close contact with the endless belts 13 and 14 while it is held by these endless belts 13 and 14. This is, the toner image T deposited on the recording sheet P is sealed by the endless belt 13 during the time the recording sheet P is processed by the fixing unit 11. The toner image T is therefore not removed from the recording sheet P when heated. And, the recording sheet P is separated from the endless belt 13 after the toner image T is sufficiently cooled and fixed on the recording sheet P so that the toner image T is not left deposited on the endless belt 13. Thus, the fixing unit 11 outputs an image in a stable quality without causing the offset.

Figure 3:
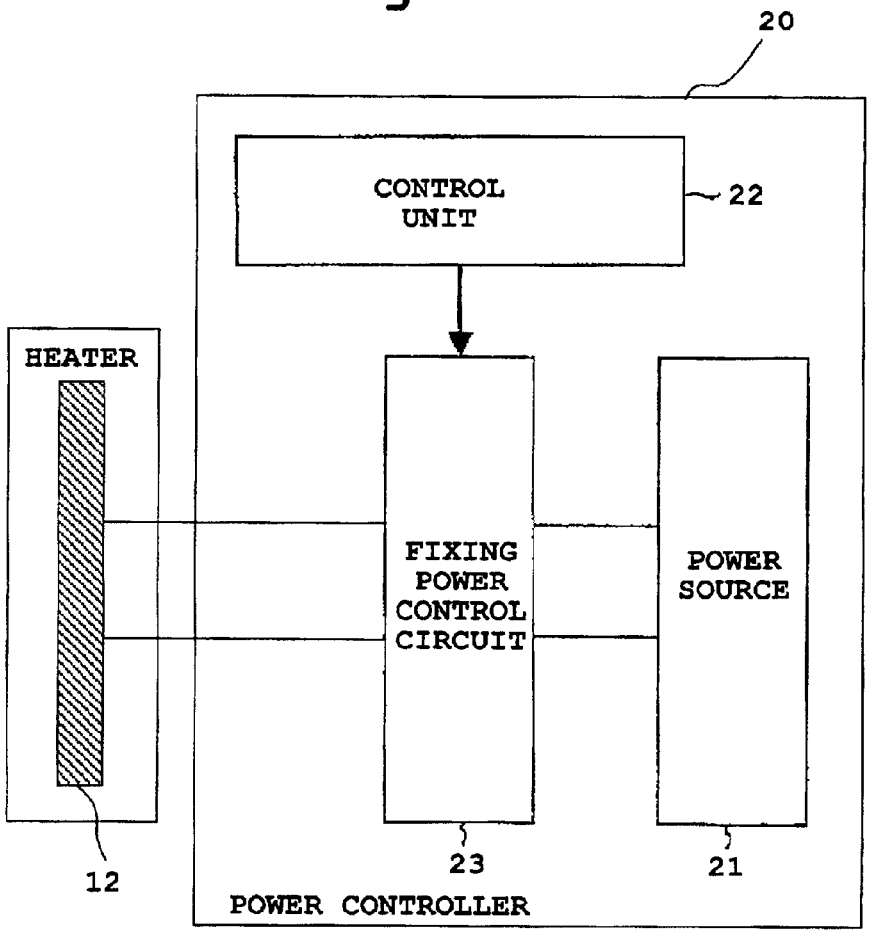
FIG. 3 is a schematic diagram of a power controller included in the image forming apparatus of FIG. 1.

The image forming apparatus 100 further includes a power controller 20, as shown in FIG. 1. The power controller 20 controls a signal of an electric power to be input to the heater 12. FIG. 3 shows a block diagram of the power controller 20. The power controller 20 includes a power source 21, a control unit 22, and a fixing power control circuit 23. The control unit 22 controls the entire operations of the image forming apparatus 100. The heater 12 is connected to the fixing power control circuit 23 to which the electric power is supplied from the power source 21 under the control of the control unit 22. More specifically, the fixing power control circuit 23 generates a heater driving signal for driving the heater 12 in accordance with the corresponding image information sent from the control unit 22 so that the heater 12 is heated up and performs the fixing process for fixing the toner image deposited on the recording sheet which is presently processed by the fixing unit 11.

The above-mentioned control unit 22 may either be separated from or unified with the power controller 20.

Figure 4:
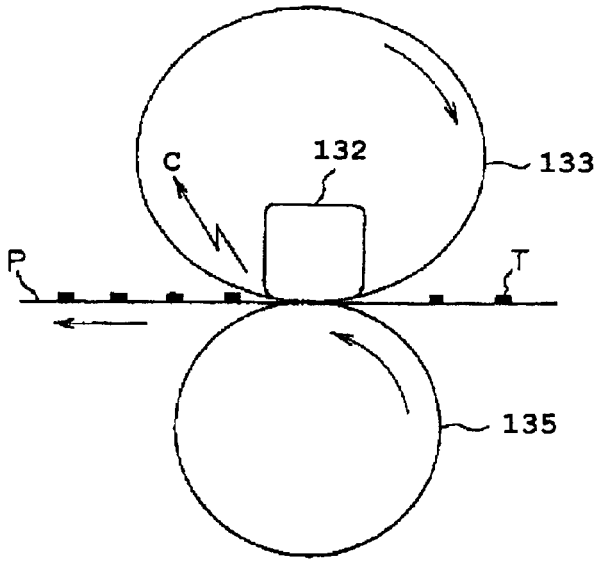
FIG. 4 is a schematic diagram of a modified fixing apparatus based on the fixing apparatus of FIG. 2.

FIG. 4 illustrates an alternative structure of the fixing unit 11. In this structure, a pressure roller 135 that serves as a pressure roller and a driving roller contacts an endless belt 133 under pressure to form a nip therebetween and drives the endless belt 133 with friction so that the endless belt 133 rotates in a direction indicated by an arrow. Therefore, when the recording sheet P is fed into the gap between the endless belt 133 and the pressure roller 135, the pressure roller 135 presses the recording sheet P against a heater 132 via the endless belt 133. The toner image T and the recording sheet P are cooled by themselves, as indicated by an arrow C, after a completion of the heat fixing process.

Figure 5A:
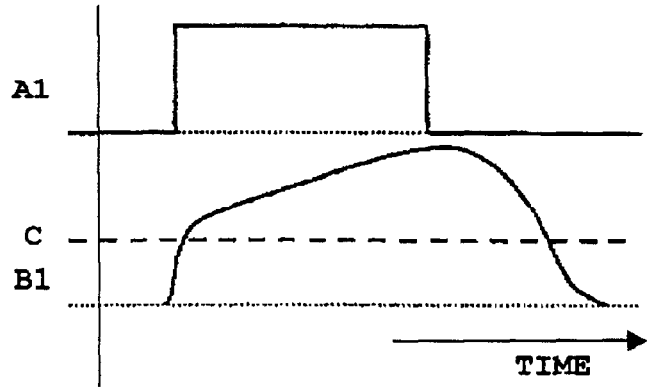
FIGS. 5A–5C are time charts for explaining a relationship between a heater driving signal and a necessary driving power and a relationship between the heater driving signal that forms a high signal with a plurality of pulses and a pulse integrate wave signal as a conveniently expressed signal.
Figure 5B:
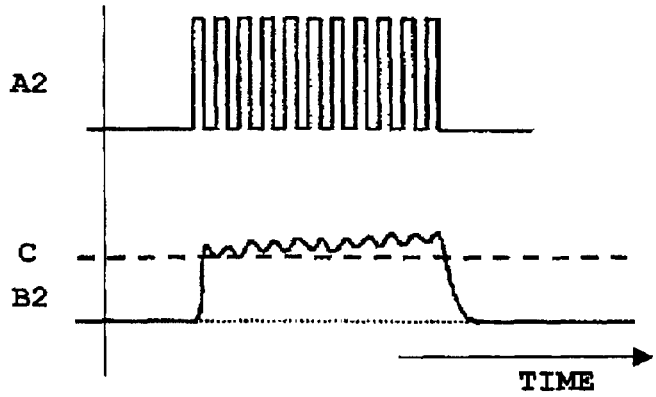
Figure 5C:
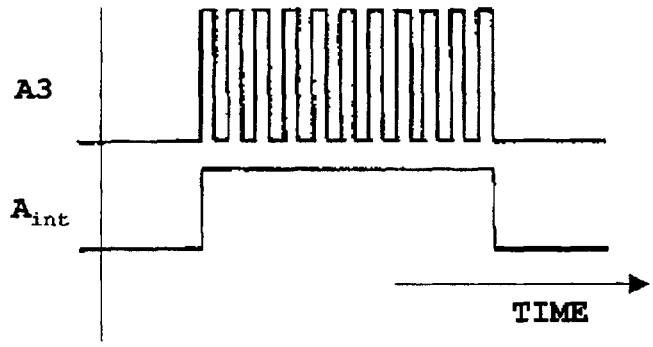

Referring to FIGS. 5A–5C, a description is made for the heater driving signal generated by the fixing power control unit 23 of the power controller 20. FIG. 5A demonstrates a relationship between a rectangular wave signal A1 for driving a heater (i.e., the heater 12) and a temperature curve B1 of the heater driven by the rectangular wave signal A1. This indicates that, when the heater is driven by the rectangular wave signal A1, the heater raises its temperature B1 far above a temperature C necessary for the heat fixing process and is eventually damaged. To make the temperature curve formed in a rectangular shape equivalent to the driving signal, driving the heater with a signal having a plurality of pulses is effective, as shown in FIG. 5B. In this case, the heater is driven by a signal A2 having a plurality of pulses and a resultant temperature curve B2 of the heater is formed like in a rectangular shape almost equivalent to the signal A2 having its peak level close to the temperature C necessary for the heat fixing process. Therefore, the fixing power control unit 23 is configured to generate the heater driving signal that has a plurality of pulses, as shown in FIG. 5B. Accordingly, the heater driving signal actually used in the image forming apparatus 100 has a plurality of pulses. However, for the sake of simplicity, such a signal having a plurality of pulses is expressed hereinafter as a pulse integrate wave signal that appears to be a simple rectangular wave signal, as shown in FIG. 5C, wherein the signal having a plurality of pulses is indicated as A3 and the signal having a pulse integral wave is indicated as $A_{int}$.

The above-mentioned pulses included in the heater driving signal generated by the fixing power control unit 23 may either have a constant or varied distant from each other and may either have a constant or varied length.

Figure 6:
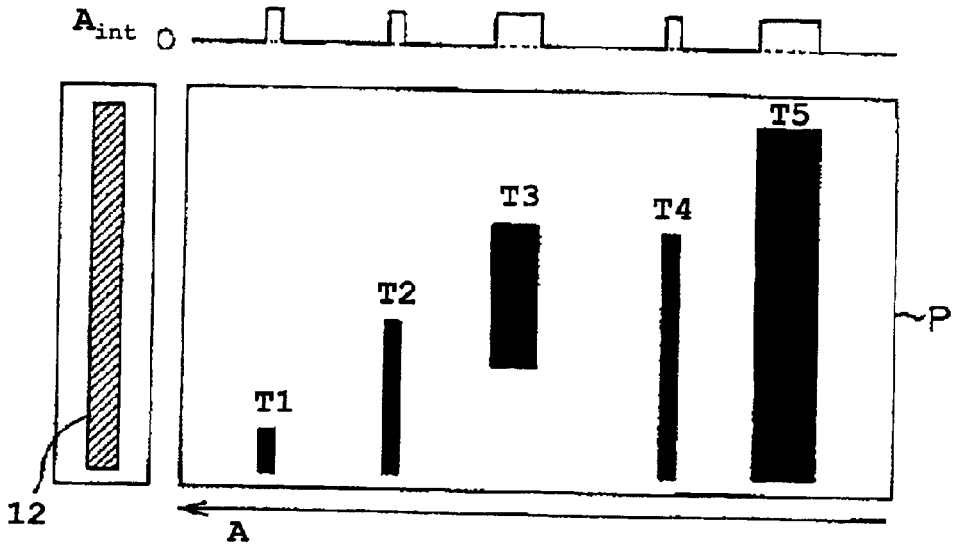
FIG. 6 is an illustration for explaining a way how an energy of electric power is saved by a fixing operation of the fixing apparatus of FIG. 2.

Referring to FIG. 6, a way how an energy of electric power is saved by the fixing operation of the above-described fixing unit 11 is explained. In the image forming apparatus 100, the heater driving signal for driving the heater 12, or the heater 32, has high and low levels and, when at a high, it includes a plurality of pulses. This high level signal is expressed as a pulse integral wave signal as described above. Hereinbelow, the heaters 12 and 32 are represented by the heater 12. FIG. 6 represents a relationship among positions of the heater 12, the recording sheet P, and the toner images T1–T5 and a relationship between the heater driving signal expressed as the signal $A_{int}$ and the toner images T1–T5, at the same time. The heater 12 is heated when the heater driving signal or the signal $A_{int}$ is activated, as shown in FIG. 6. When the signal $A_{int}$ is activated to a high the heater 12 is turned on for heating and when the signal $A_{int}$ is deactivated to a low the heater 12 is turned off.

FIG. 6 attempts to express a way how the energy of the electric power for the fixing process is saved when the recording sheet P having toner images T1–T5, for example, is processed by the fixing unit 11. As shown in FIG. 6, the toner images T1–T5 are different in size from each other, for example. During the time the recording sheet P passes through the fixing unit 11, the signal $A_{int}$ is raised to a high so as to drive the heater 12 each time one of the toner images T1–T5 is brought close to the heater 12. The signal $A_{int}$ is dropped to a low so as to turn off the heater 12 when each of the toner images T1–T5 is brought away from the heater 12 as the recording sheet P is being transferred in the fixing unit 11. During the time a white area having no toner image in the recording sheet P is passing by the heater 12, the signal $A_{int}$ is not raised to a high and therefore the heater 12 is not driven.

In this way, the fixing unit 11 can greatly save the energy of electric power through its fixing operation, as described above. This would be readily understood by comparing it with a case where the heater 12 is always driven with a continuous driving signal. For example, a text image that has lines of characters typically includes spaces between the lines. When such an image is processed by the fixing unit 11, the signal $A_{int}$ is held at a low at which no electric energy is consumed during the time periods corresponding to these spaces. Thus, a great amount of electric power can be saved.

Figure 7:
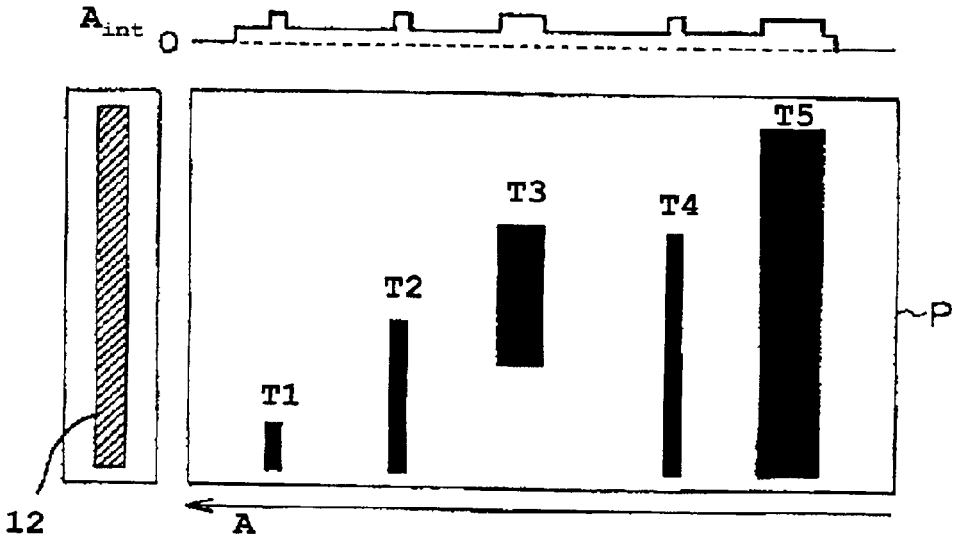
FIG. 7 is an illustration for explaining a modification of the fixing operation explained with reference to FIG. 6.

FIG. 7 shows a modification of the fixing power control performed by the fixing power control unit 23. As indicated in FIG. 7, the signal $A_{int}$ has three levels; a zero level, a white level, and a black level. The signal $A_{int}$ is held at the zero level so as not to drive the heater 12 during the time the recording sheet P is not present in the fixing unit 11. The signal $A_{int}$ is raised to the white level so as to pre-heat the heater 12 when the recording area of the recording sheet P is brought close to the heater 12. The signal $A_{int}$ is raised from the white level to the black level so as to heat the heater 12 when the toner image T1 is brought close to the heater 12 and is dropped back to the white level so as to pre-heat the heater 12 when the toner image T1 is brought away from the heater 12. The signal $A_{int}$ is again raised to the black level so as to heat the heater 12 when the next toner image T2 is brought close to the heater 12 and is dropped back to the white level so as to pre-heat the heater 12 when that toner image T2 is brought away from the heater 12. This cycle is repeated for each toner image. The signal $A_{int}$ is dropped down to the zero level so as to turn off the heater 12 when the recording area of the recording sheet P brought away from the heater 12.

The black level is a level in which the heater 12 is driven in a full power. The white level is a level at which the heater 12 is pre-heated with an electric power having a reduction by 5% or more from the power of the black level.

With the above modified fixing power control, the heater 12 is improved in responsivity while achieving the energy saving.

Figure 8:
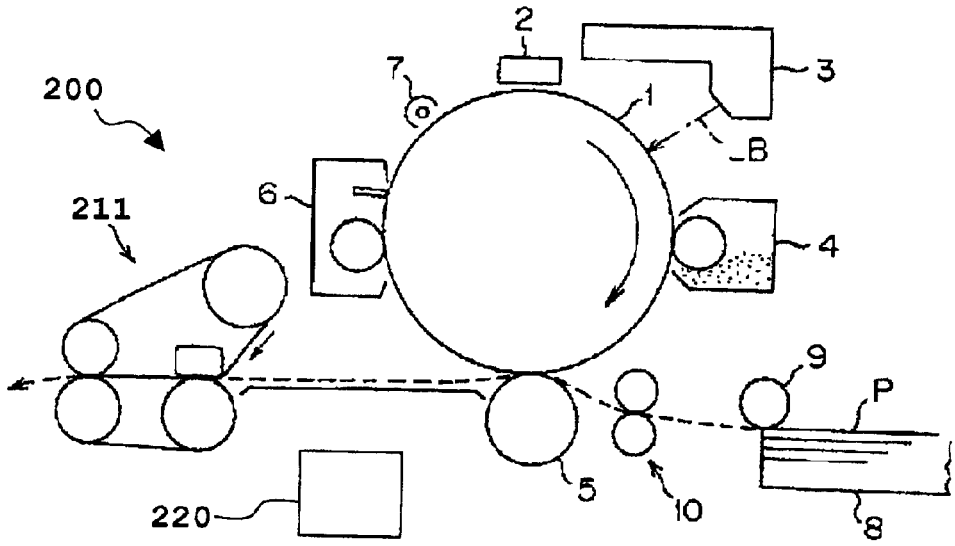
FIG. 8 is a schematic diagram of an image forming apparatus including another fixing apparatus according to an embodiment of the present invention.
Figure 9:
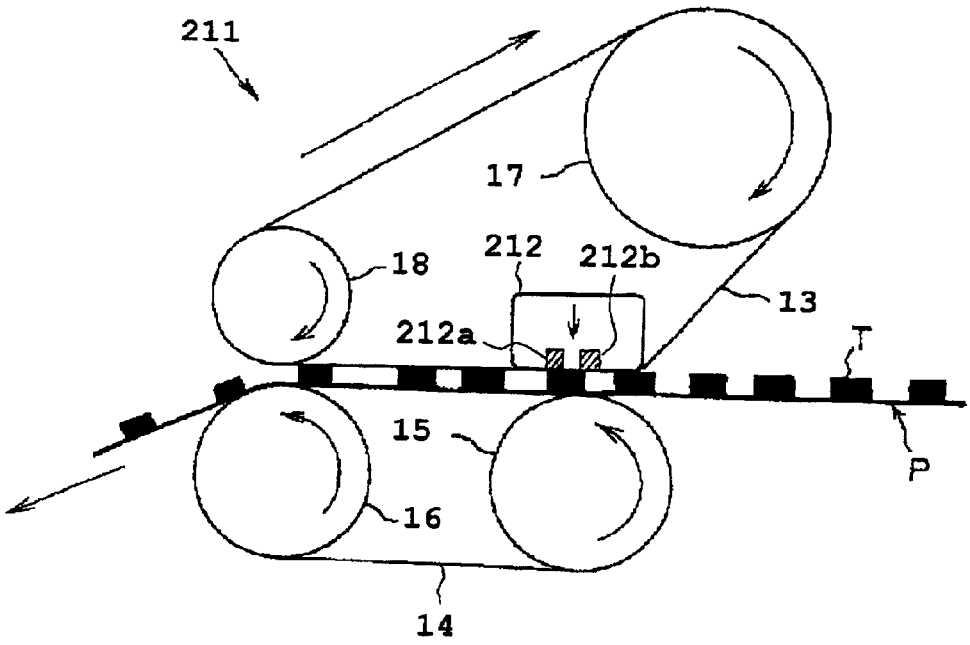
FIG. 9 is a schematic diagram of the fixing apparatus included in the image forming apparatus of FIG. 8.
Figure 10:
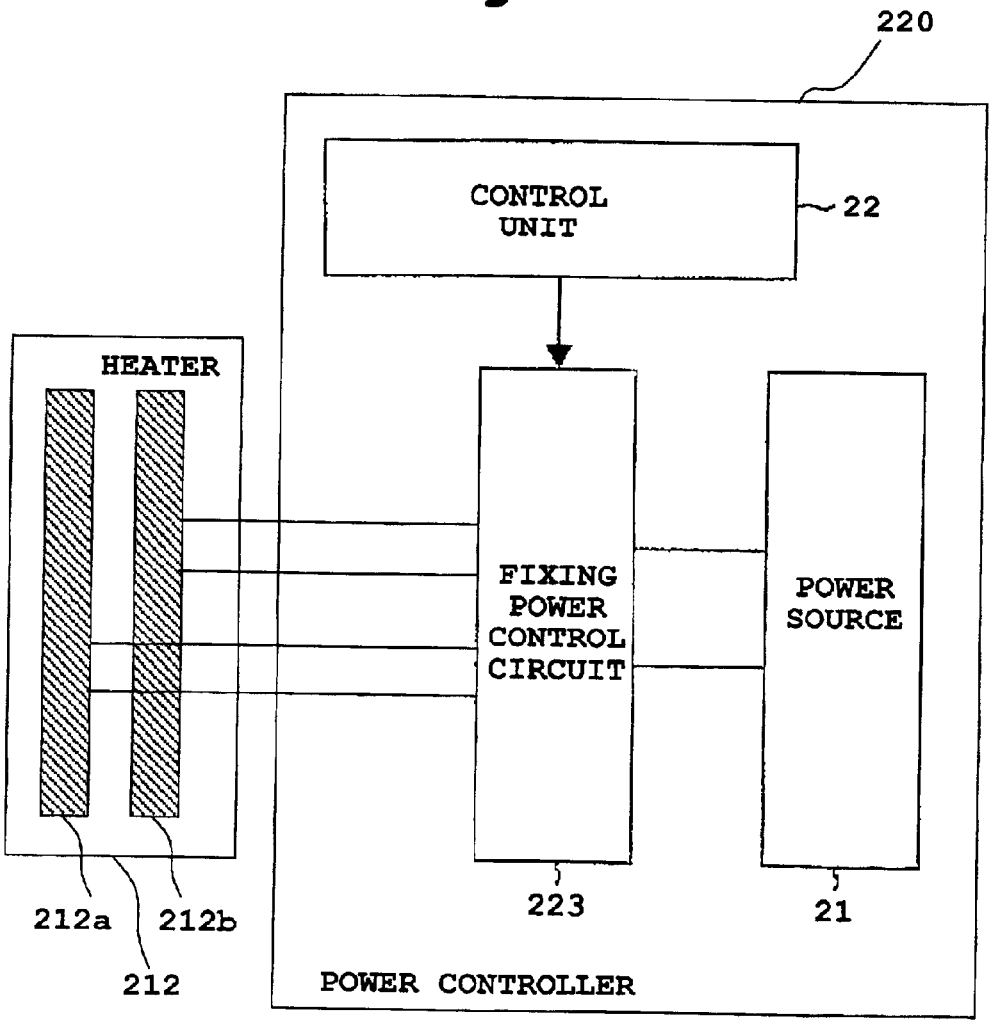
FIG. 10 is a schematic diagram of a power controller included in the image forming apparatus of FIG. 8.

Next, another image forming apparatus 200 according to the embodiment of the present invention is explained with reference to FIGS. 8–10. As shown in FIG. 8, the image forming apparatus 200 is similar to that of FIG. 1, except for a fixing unit 211 and a power controller 220. The fixing unit 211 is, as shown in FIG. 9, similar to the fixing unit 11 of FIG. 2, except for a heater 212 that includes heating member 212*a* and 212*b* for heating the toner image T. The power controller 220 is shown in FIG. 10 and is similar to the power controller 20 of FIG. 3, except for a fixing power control circuit 223. The fixing power control circuit 223 has separate connections to the heating members 212*a* and 212*b* of the heater 212, as shown in FIG. 10, and generates the heater driving signals for driving the heating members 212*a* and 212*b*, respectively, in accordance with the corresponding image information sent from the control unit 22. Thereby, heating members 212*a* and 212*b* of the heater 212 are heated up to perform the fixing process in accordance with the corresponding toner images deposited on the recording sheet P which is presently processed in the fixing unit 211. The above-mentioned heater driving signals are composed of a plurality of pulses and are hereinafter expressed as the pulse integrate wave signals $A_{int\text{-}a}$ and $A_{int\text{-}b}$, as is the case explained with reference to FIGS. 5A–5C.

It is noted that the above-described control unit 22 may either be separated from or unified with the power controller 220.

Each of the heating member 212*a* and 212*b* of the heater 212 is a thermal head or a heater, for example, having a line shape, and heats the toner image T. The heater 212 is arranged at a position so that the heating members 212*a* and 212*b* are orthogonal to the sheet transfer direction. The heating members 212*a* and 212*b* are selectively driven by the fixing power control circuit 223 of the power controller 220 such that the heating members 212*a* and 212*b* are not driven at the same time. The heating members 212*a* and 212*b* are desirably arranged with a distant smaller than 10 mm from each other. The heater 212 is superior when the distant between the heating members 212*a* and 212*b* is 6 mm or less, is more superior when the distant is 4 mm or less, is far more superior when the distant is 2 mm or less, and is extremely superior when the distant is 1 mm or less. The width of each heating member is desirably within a range of from 0.01 mm to 5 mm. The heater 212 is superior when the width of each heating member is within a range between 0.1 mm and 4 mm, is more superior when the width is in a range between 0.2 mm and 2 mm, and far more superior when the width is within a range between 0.5 mm to 1 mm.

In the above-described fixing unit 211, the toner image T on the recording sheet P is heated by the heating members 212*a* and 212*b* of the heater 212 via the endless belt 13 when the recording sheet P is fed into the gap between the endless belts 13 and 14. After that, the recording sheet P is subjected to a cooling process by which the toner image T is firmly fixed to the recording sheet P and is then separated from the endless belt 14. At least one of the guide rollers 16 and 18, arranged downstream from the heater 212 in the sheet transfer direction, is made of metal having a relatively high thermal conductivity and serves as a driving roller and a cooling roller, as is the case with the fixing unit 11 of FIG. 2. After a completion of the heat fixing process, the toner image T, the recording sheet P, and the endless belt 13 are cooled by the guide rollers 16 and 18. The recording sheet P makes close contact with the endless belts 13 and 14 while it is held by these endless belts 13 and 14. That is, the toner image T deposited on the recording sheet P is sealed by the endless belt 13 during the time the recording sheet P is processed by the fixing unit 211. The toner image T is therefore not removed from the recording sheet P when heated. And, the recording sheet P is separated from the endless belt 13 after the toner image T is sufficiently cooled and fixed on the recording sheet P so that the toner image T is not left deposited on the endless belt 13. Thus, the fixing unit 211 outputs an image in a stable quality without causing the offset.

In the fixing unit 211, the heater 212 may include one or more additional heating members in addition to the heating members 212*a* and 212*b*.

Figure 11:
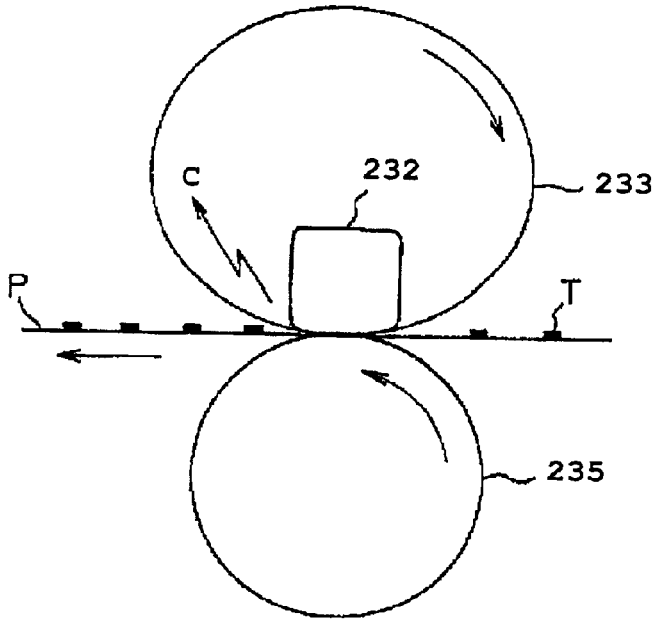
FIGS. 11 and 12 are schematic diagrams for explaining a modified fixing apparatus based on the fixing apparatus of FIG. 9.

FIG. 11 illustrates an alternative structure of the fixing unit 211. In this structure, a pressure roller 235 that serves as a pressure roller and a driving roller contacts an endless belt 233 under pressure to form a nip therebetween and drives the endless belt 233 with friction so that the endless belt 233 rotates in a direction indicated by an arrow. Therefore, when the recording sheet P is fed into the gap between the endless belt 233 and the pressure roller 235, the pressure roller 235 presses the recording sheet P against a heater 232 via the endless belt 233. The toner image T and the recording sheet P are cooled by themselves, as indicated by an arrow C, after a completion of the heat fixing process.

Figure 12:
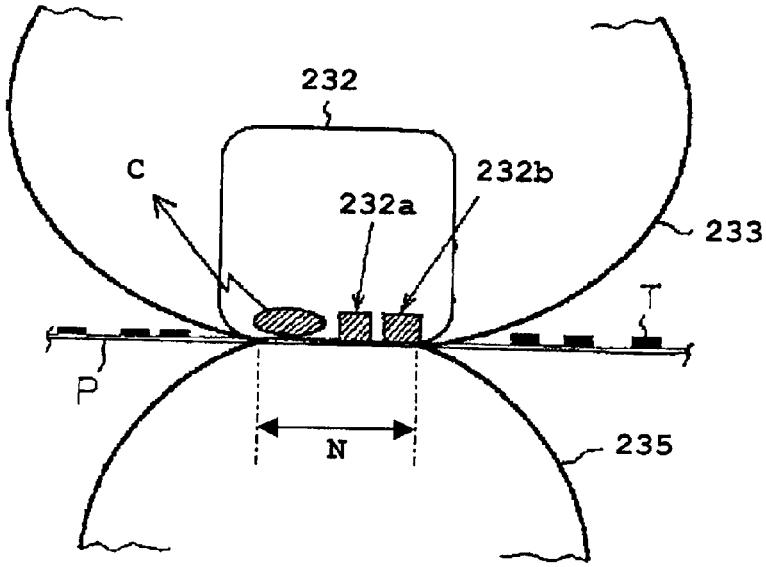

FIG. 12 demonstrates that, in the above-described alternative structure of FIG. 11, the heater 232 includes heating members 232*a* and 232*b* arranged orthogonal to the sheet transfer direction and a cooling portion C arranged downstream from the heating members 232*a* and 232*b* in the sheet transfer direction. Further, the nip formed between the endless belt 233 and the pressure roller 235 is extended from the heating area of the heating members 232*a* and 232*b* to the cooling portion C, as indicated by a letter N. Thereby, the toner image T on the recording sheet P is sealed by the endless belt 233 during the time the recording sheet P is processed through the fixing process. This protects removal of the toner image T from the recording sheet P. Then, the recording sheet P is subjected to the cooling process when passing by the cooling portion C. After cooled and fixed, the recording sheet P is separated from the endless belt 233. As a result, the toner image T is not left deposited on the endless belt 13 through this heat fixing process. Thus, a highly stable quality image is output without causing the offset.

In the above structure of FIGS. 11 and 12, the cooling portion C may use any one of cooling by itself, cooling with air, cooling with water, refrigerative including fluorocarbon, Peltier element, and the like.

Further, in the above structure of FIGS. 11 and 12, the heater 232 may include one or more additional heating members in addition to the heating members 232*a* and 232*b*.

When the image forming process is performed in high speed, it affects the fixing process by the fixing unit such that an increasing amount of heat is absorbed by the endless belt and therefore the temperature of the heater needs to be increased. However, the image forming apparatus 200 employs the heating members 212*a* and 212*b* in the heater 212 to maintain a total amount of heat unchanged without increasing the temperature of the heater. Thus, the heating members of the heater are protected from the damage caused by a high temperature. In the description below, two heater driving signals for driving the heating members 212*a* and 212*b* of the heater 212 are expressed as pulse integral wave signals $A_{int\text{-}a}$ and $A_{int\text{-}b}$, respectively.

Figure 13A:
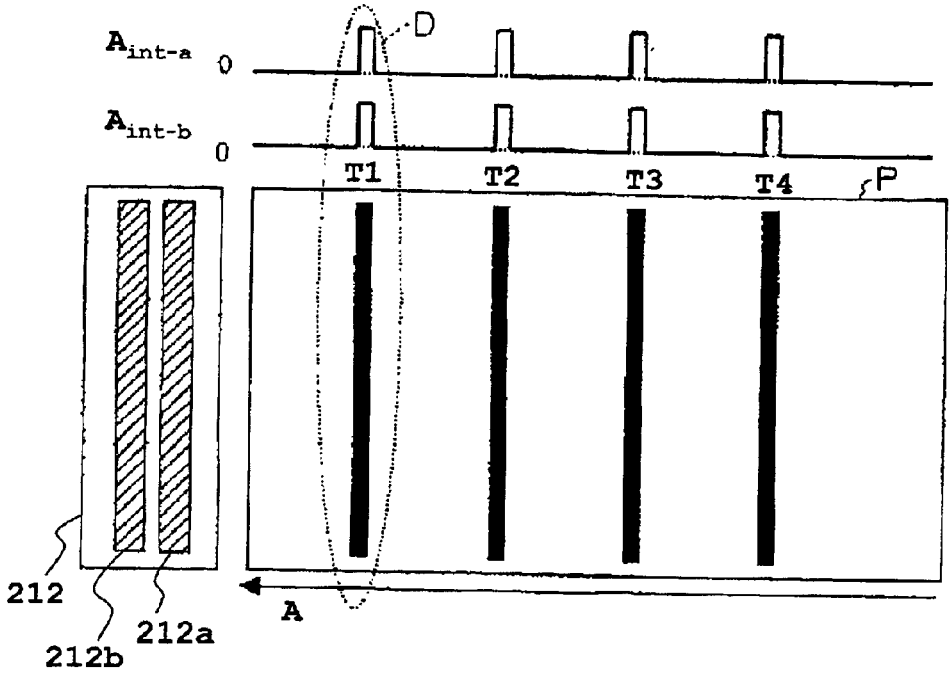
FIGS. 13A and 13B are illustrations for explaining a way how an energy of electric power is saved by a fixing operation of the fixing apparatus of FIG. 9.

FIG. 13A expresses a way how the energy of the electric power for the fixing process is saved when the recording sheet P having toner images T1–T4, for example, is processed by the fixing unit 211. In this case, the toner images T1–T4 have the same width and length, as shown in FIG. 13A. During the time the recording sheet P is processed through the fixing unit 211, the signals $A_{int\text{-}a}$ and $A_{int\text{-}b}$ are switched between the white and black levels so as to drive the heating members 212*a* and 212*b* of the heater 212 each time one of the toner images T1–T4 is brought close to the respective heating members of the heater 212. Thereby, the toner image T1 is heated and accordingly fixed on the recording sheet P. The signals $A_{int\text{-}a}$ and $A_{int\text{-}b}$ are not raised and therefore the heating members 212*a* and 212*b* of the heater 212 are not driven during the time a white area having no toner image in the recording sheet P is brought to be passing by the heater 212.

Figure 13B:
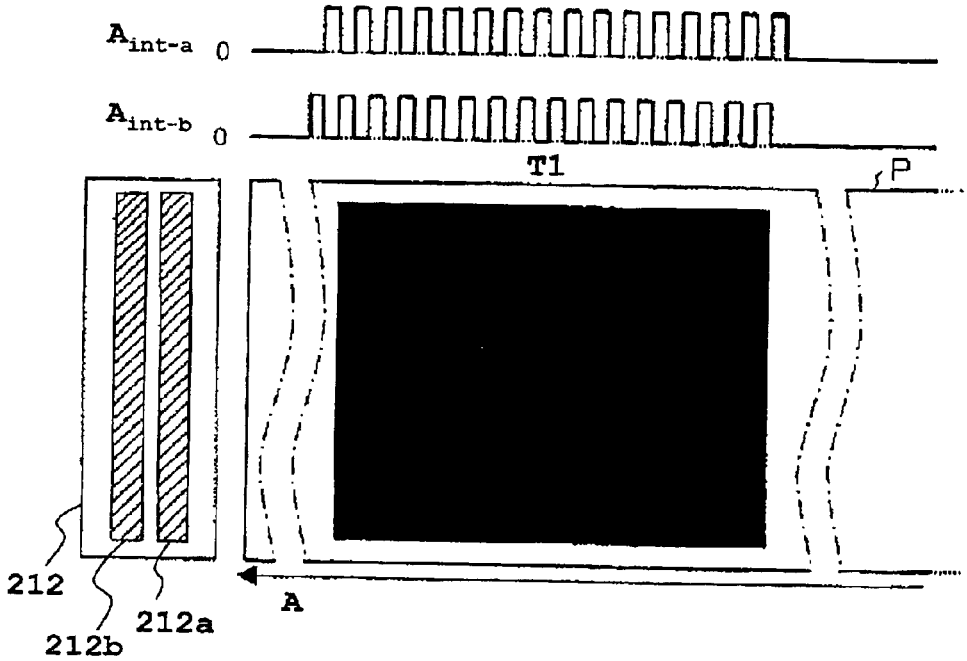

More specifically, a way of driving the heating members 212*a* and 212*b* is explained with reference to FIG. 13B that shows an enlarged part of FIG. 13A. That is, FIG. 13A shows an area circled with a dotted line indicated by a letter D and this area is shown in FIG. 13B in a manner enlarged in the sheet transfer direction. When the toner image T1 is brought close to the heating member 212*a*, driving the heating member 212*a* is started with at least one precedent pulse of the signal $A_{int\text{-}a}$. Likewise, when the toner image T1 is brought close to the heating member 212*b*, driving the heating member 212*b* is started with at least one precedent pulse of the signal $A_{int\text{-}b}$.

As also shown in FIG. 13B, the pulses included in the signals $A_{int-a}$ and $A_{int-b}$ are alternately raised to a high but not at the same time. This leads to a great amount of reduction of the power consumption. That is, in comparison with a case where the signals $A_{int-a}$ and $A_{int-b}$ are raised to a high at the same time, the power consumption per a unit time period is saved to extend approximately half of it. It is noted that the experiment was conducted in which the amount of the power consumption was 1200 watts when the signals $A_{int-a}$ and $A_{int-b}$ are raised to a high at the same time but it was reduced to 600 watts when the signals $A_{int-a}$ and $A_{int-b}$ are alternately raised to a high.

Thus, the fixing unit 211 can greatly save the energy of electric power through its fixing operation, as described above. This would be readily understood by comparing it with a case where the heating members 212*a* and 212*b* of the heater 212 are always driven with continuous driving signals. For example, a text image that has lines of characters typically includes spaces between the lines. When such an image is processed by the fixing unit 211, the signals $A_{int-a}$ and $A_{int-b}$ are held at a low at which no electric energy is consumed during the time periods corresponding to these spaces. Thus, a great amount of electric power can be saved.

Figure 14A:
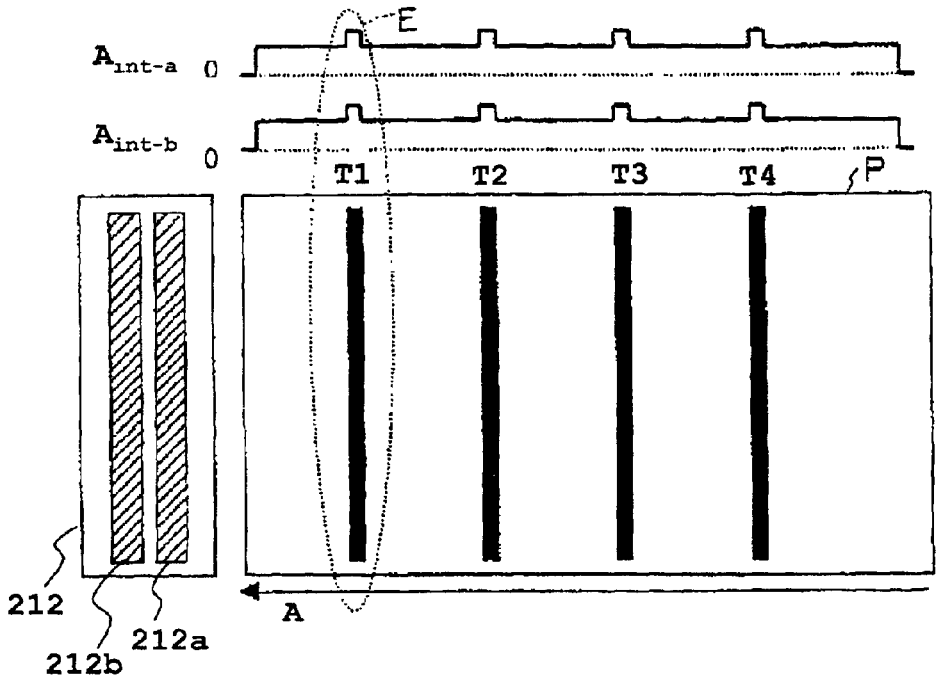
FIGS. 14A and 14B are illustrations for explaining a modification of the fixing operation explained with reference to FIG. 13A.

FIG. 14A shows a modification of the fixing power control performed by the fixing power control unit 223. As in the case of the fixing power control unit 23 of FIG. 3, each of the signals $A_{int-a}$ and $A_{int-b}$ has three levels; a zero level, a white level, and a black level. The signals $A_{int-a}$ and $A_{int-b}$ are held at the zero level so as to deactivate the heating members 212*a* and 212*b* of the heater 212 when the recording sheet P is not present in the fixing unit 211. The signals $A_{int-a}$ and $A_{int-b}$ are raised to the white level so as to pre-heat the heating members 212*a* and 212*b* of the heater 212 when the image area of the recording sheet P is brought close to the heating members 212*a* and 212*b* of the heater 212 after the recording sheet P is fed into the fixing unit 211. The signals $A_{int-a}$ and $A_{int-b}$ are further raised to the black level so as to heat up the heating members 212*a* and 212*b*, respectively, when the toner image T1 is brought close to the heating members 212*a* ad 212*b*. Then, the signals $A_{int-a}$ and $A_{int-b}$ are dropped back to the white level so as to pre-heat the heating members 212*a* and 212*b*, respectively, when the toner image T1 is brought away from the heating members 212*a* and 212*b*. The signals $A_{int-a}$ and $A_{int-b}$ are again raised to the black level so as to heat the heating members 212*a* and 212*b*, respectively, when the next toner image T2 is brought close to the heating members 212*a* and 212*b*. Then the signals $A_{int-a}$ and $A_{int-b}$ are dropped back to the white level so as to pre-heat the heating members 212*a* and 212*b*, respectively when that toner image T2 is brought away from the heating members 212*a* and 212*b*. This cycle is repeated until the toner image T4 is brought away from the heating members 212*a* and 212*b* of the heater 212. After the toner image T4, the signals $A_{int-a}$ and $A_{int-b}$ are dropped down to the zero level so as to deactivate the heating members 212*a* and 212*b*, respectively, when the image area of the recording sheet P is brought away form the heating members 212*a* and 212*b*.

The black level is a level in which the heater 212 is driven in a full power. The white level is a level in which the heater 212 is primarily heated with an electric power with a reduction of 5% or more from the power of the black level.

Figure 14B:
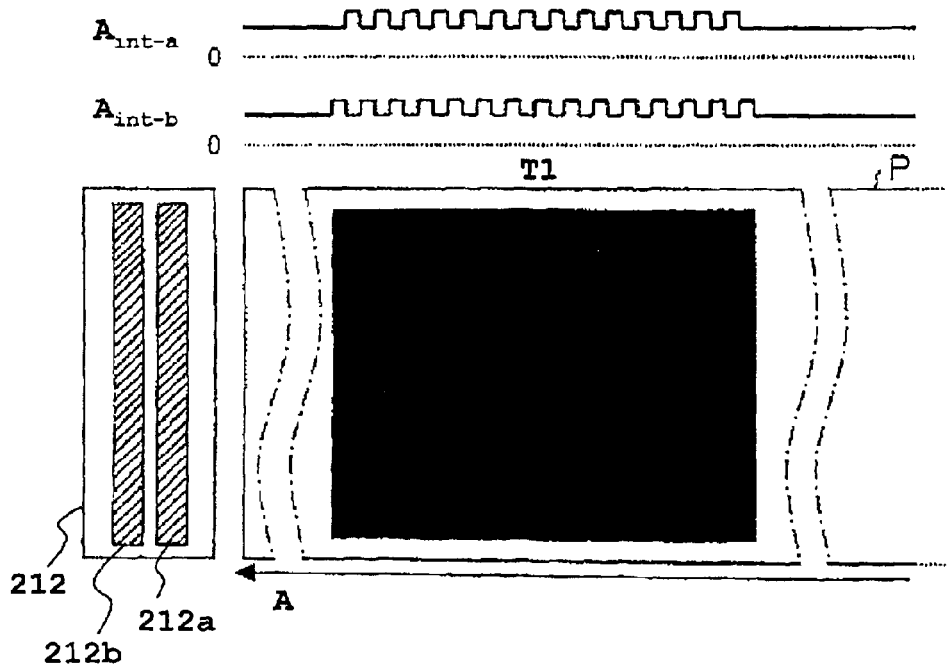

FIG. 14B explains more specifically a way of driving the heating members 212*a* and 212*b*. FIG. 14B shows an enlarged part of FIG. 14A. That is, an area circled with a dotted line indicated by a letter D shown in FIG. 14A is shown in FIG. 14B in a manner enlarged in the sheet transfer direction. When the toner image T1 is brought close to the heating member 212*a*, driving the heating member 212*a* is started with at least one precedent pulse of the signal $A_{int-a}$ which is raised from the white level to the black level. Likewise, when the toner image T1 is brought close to the heating member 212*b*, driving the heating member 212*b* is started with at least one precedent pulse of the signal $A_{int-a}$ which is raised from the white level to the black level.

As also shown in FIG. 14B, the pulses included in the signals $A_{int-a}$ and $A_{int-b}$ are alternately raised to a high but not at the same time. This leads to a great amount of reduction of the power consumption. That is, in comparison with a case where the signals $A_{int-a}$ and $A_{int-b}$ are raised to a high at the same time, the power consumption per a unit time period is saved to extend approximately half of it. It is noted that the experiment was conducted in which the white level had a 5% power reduction from the full power of the black level. In this experiment, the amount of the power consumption was recorded as 1200 watts when the signals $A_{int-a}$ and $A_{int-b}$ are raised to a high at the same time. However, the amount of the power consumption was reduced to 570 watts when the signals $A_{int-a}$ and $A_{int-b}$ are alternately raised. This is because the 5% power reduction contributed for a further reduction of 30 watts.

Thus, the fixing unit 211 can greatly save the energy of electric power through its fixing operation, as described above. This would be readily understood by comparing it with a case where the heating members 212*a* and 212*b* of the heater 212 are always driven with continuous driving signals. For example, a text image that has lines of characters typically includes spaces between the lines. When such an image is processed by the fixing unit 211, the signals $A_{int-a}$ and $A_{int-b}$ are held at the white level at which an electric power can be reduced by 5% or more during the time periods corresponding to the above-mentioned spaces. Thus, a great amount of electric power can be saved.

With the above modified fixing power control, the heater 212 is improved in responsivity while achieving the energy saving.

Figure 15:
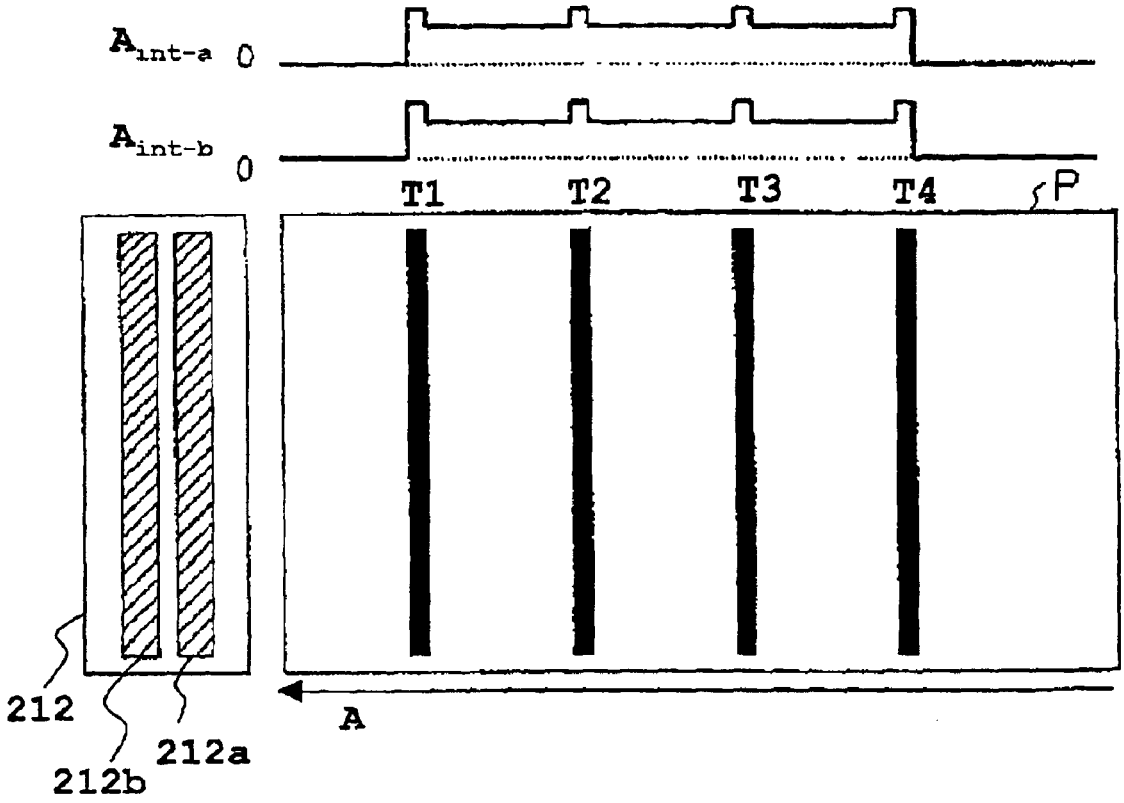
FIG. 15 is an illustration for explaining another modification of the fixing operation explained with reference to FIG. 13A.

FIG. 15 shows another modification of the fixing power control performed by the fixing power control unit 223. This modification is similar to that of FIG. 14A, except for the control of the zero level before the toner image T1 and after the toner image T4. More specifically, in this modification of FIG. 15, during the time the recording area of the recording sheet P is between the leading edge of the recording sheet and the first toner image T1 is brought close to the heating members, the signals $A_{int-a}$ and $A_{int-b}$ are held at the zero level so as to deactivate the heating members 212*a* and 212*b*. Also, the signals $A_{int-a}$ and $A_{int-b}$ are held at the zero level so as to deactivate the heating members 212*a* and 212*b* during the time the recording area of the recording sheet P is between the last toner image T3 and the trailing edge of the recording sheet is brought close to the heating members.

With the above-described modification shown in FIG. 15, more efficient energy savings can be achieved.

Figure 16:
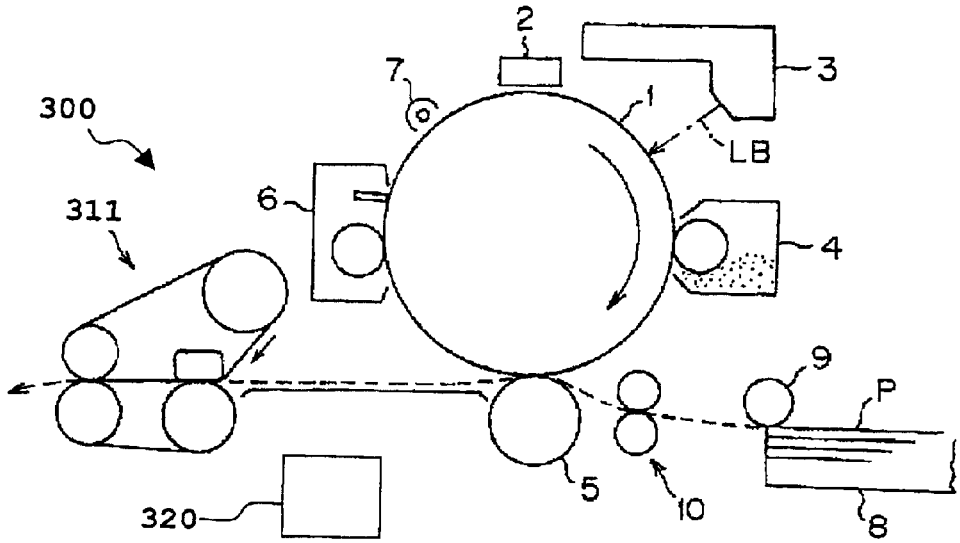
FIG. 16 is a schematic diagram of an image forming apparatus including another fixing apparatus according to an embodiment of the present invention.
Figure 17:
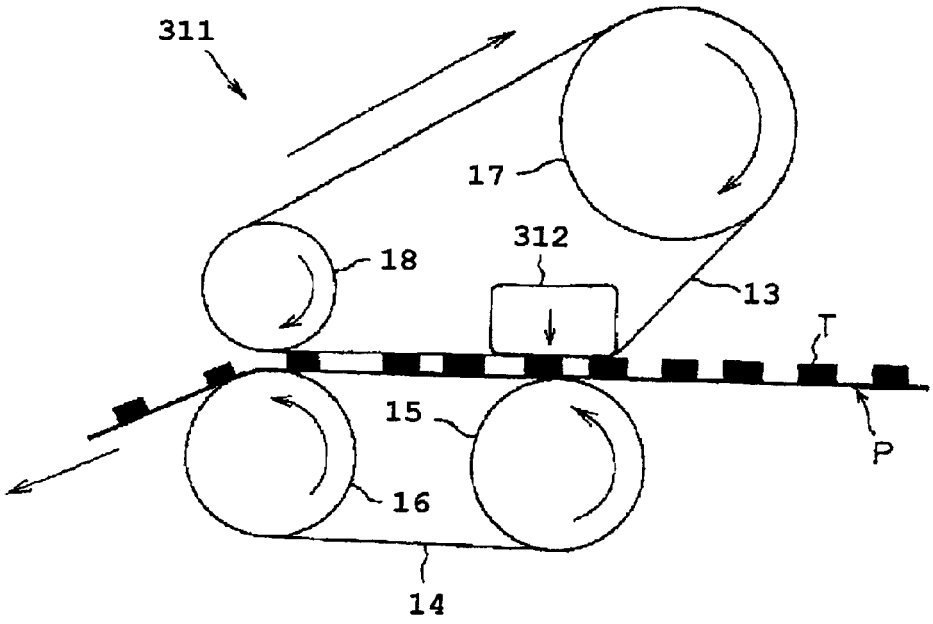
FIG. 17 is a schematic diagram of the fixing apparatus included in the image forming apparatus of FIG. 16.
Figure 18:
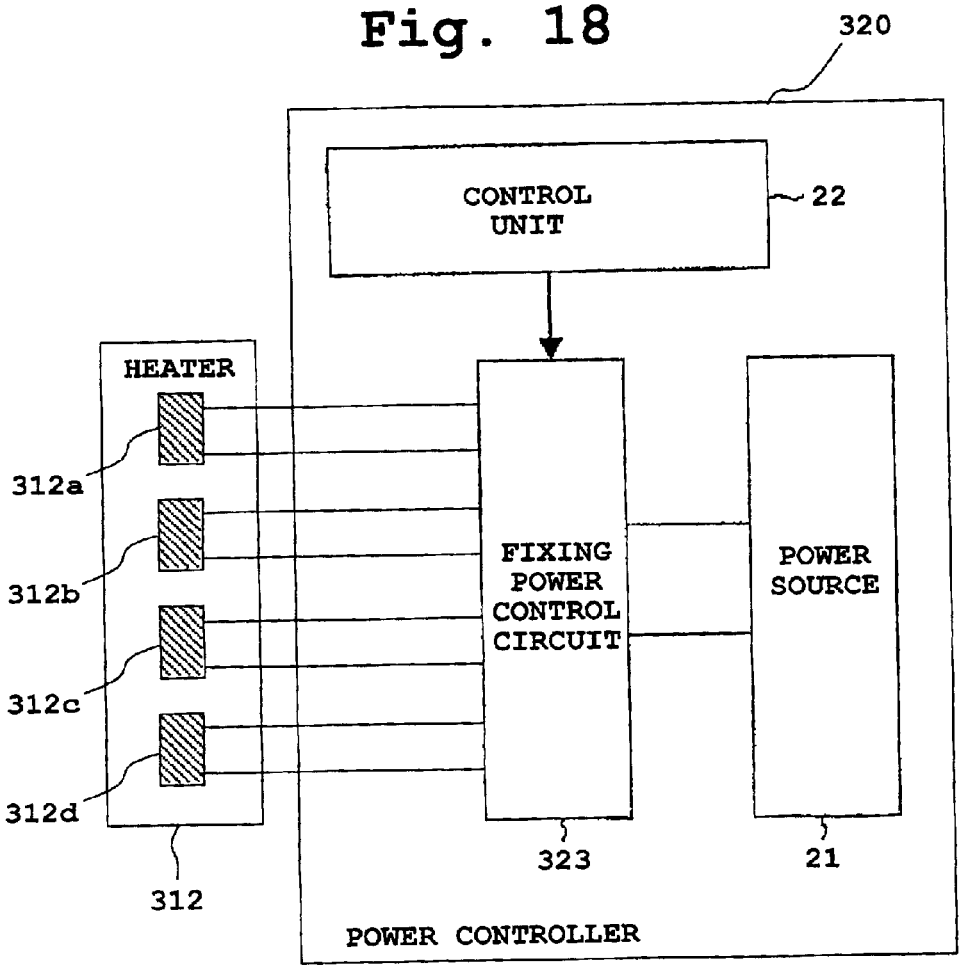
FIG. 18 is a schematic diagram of a power controller included in the image forming apparatus of FIG. 16.

Next, another image forming apparatus 300 according to the embodiment of the present invention is explained with reference to FIGS. 16–18. As shown in FIG. 16, the image forming apparatus 300 is similar to that of FIG. 1, except for fixing unit 311 and a power controller 320. The fixing unit 311 is, as shown in FIG. 17, similar to the fixing unit 11 of FIG. 2, except for a heater 312 that includes heating member 312*a*–312*d* for heating the toner image T. The power controller 320 is shown in FIG. 18 and is similar to the power controller 320 is shown in FIG. 18 and is similar to the power controller 20 of FIG. 3, except for a fixing power control circuit 323. The fixing power control circuit 323 has separate connections to the heating members 312*a*–312*d*, as shown in FIG. 18, and generates the heater driving signals for driving the heating members 312*a*–312*d*, respectively, in accordance with the corresponding image information sent from the control unit 22. Thereby, the heating members 312*a*–312*d* of the heater 312 are heated up and perform the fixing process in accordance with the corresponding toner images deposited on the recording sheet P. The above-mentioned heater driving signals are composed of a plurality of pulses and are hereinafter expressed as the pulse integrate wave signals $A_{int-a}$ and $A_{int-d}$, as is the case explained with reference to FIGS. 5A–5C.

It is noted that the above-described control unit 22 may either be separated from or unified with the power controller 320.

Each of the heating member 312*a*–312*d* of the heater 312 is a thermal head or a heater, for example, having a line shape, and heats the toner image T. The heating member 312*a*–312*d* are arranged in line in the heater 312. The heater 312 is arranged at a position so that the heating members 312*a*–312*d* are orthogonal relative to the sheet transfer direction. The heating members 312*a*–312*d* are selectively driven by the fixing power control circuit 323 of the power controller 320 such that the heating members 312*a*–312*d* are not driven at the same time.

In the above-described fixing unit 311, the toner image T on the recording sheet P is heated by the heating members 312*a*–312*d* of the heater 312 via the endless belt 13 when the recording sheet P is fed into the gap between the endless belts 13 and 14. After that, the recording sheet P is subjected to a cooling process by which the toner image T is firmly fixed to the recording sheet P and is then separated from the endless belt 14. At least one of the guide rollers 16 and 18, arranged downstream from the heater 312 in the sheet transfer direction, is made of metal having a relatively high thermal conductivity and serves as a driving roller and a cooling roller, as is the case with the fixing unit 11 of FIG. 2. After a completion of the heat fixing process, the toner image T, the recording sheet P, and the endless belt 13 are cooled by the guide rollers 16 and 18. The recording sheet P makes close contact with the endless belts 13 and 14 while it is held by these endless belts 13 and 14. That is, the toner image T deposited on the recording sheet P is sealed by the endless belt 13 during the time the recording sheet P is processed by the fixing unit 311. The toner image T is therefore not removed from the recording sheet P when heated. And, the recording sheet P is separated from the endless belt 13 after the toner image T is sufficiently cooled and fixed on the recording sheet P so that the toner image T is not left deposited on the endless belt 13. Thus, the fixing unit 311 outputs an image in a stable quality without causing the offset.

In the fixing unit 311, the heater 312 may include any number of the heating members in place of the heating members 312*a*–312*d*.

Figure 19:
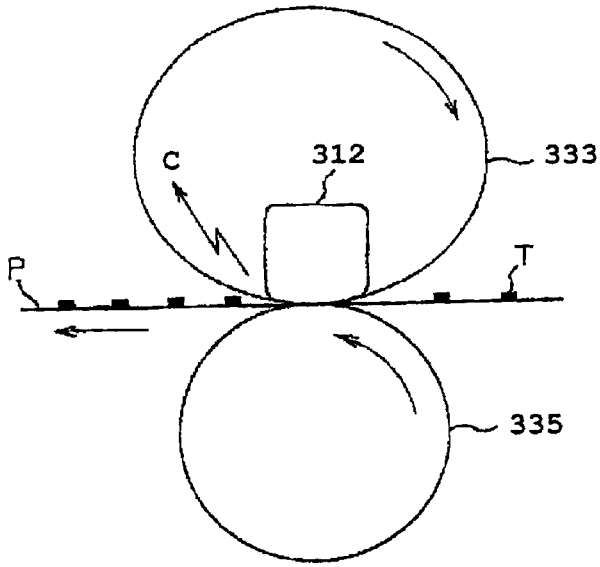
FIG. 19 is a schematic diagram for explaining a modified fixing apparatus based on the fixing apparatus of FIG. 17.

FIG. 19 illustrates an alternative structure of the fixing unit 311. In this structure, a pressure roller 335 that serves as a pressure roller and a driving roller contacts an endless belt 333 under pressure to form a nip therebetween and drives the endless belt 333 with friction so that the endless belt 333 rotates in a direction indicated by an arrow. Therefore, when the recording sheet P is fed into the gap between the endless belt 333 and the pressure roller 335, the pressure roller 335 presses the recording sheet P against a heater 332 via the endless belt 333, wherein the heater 332 has a plurality of heating members as in the case shown in FIG. 18. In this structure, the toner image T and the recording sheet P are cooled by themselves, as indicated by an arrow C, after a completion of the heat fixing process.

Figure 20:
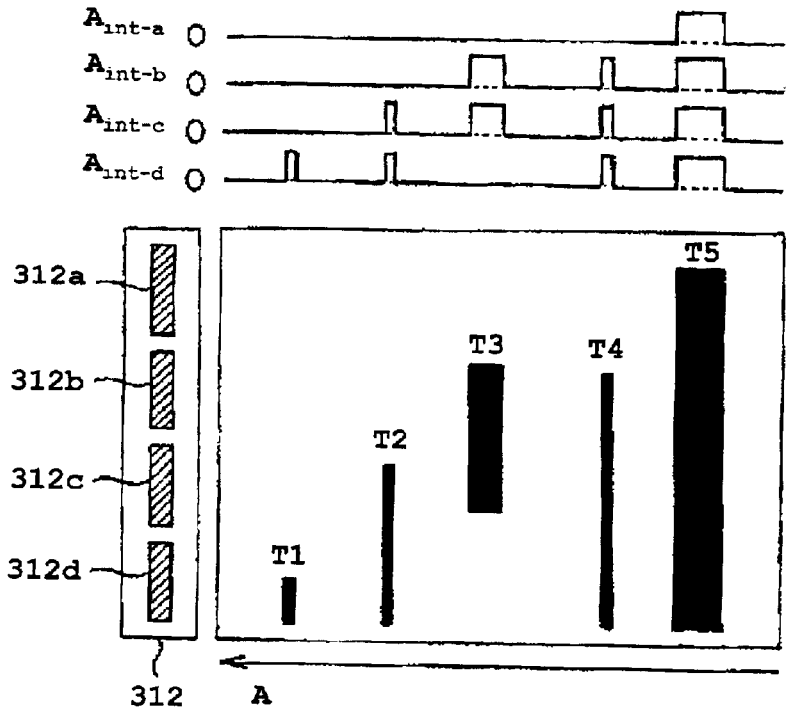
FIG. 20 is an illustration for explaining a way how an energy of electric power is saved by a fixing operation of the fixing apparatus of FIG. 17.

FIG. 20 expresses a way how the energy of the electric power for the fixing process is saved when the recording sheet P having toner images T1–T5, for example, is processed by the fixing unit 311. In this case, the toner images T1–T5 are different in size from each other, as shown in FIG. 20. During the time the recording sheet P is present and processed in the fixing unit 311, the signals $A_{int-a}$ and $A_{int-d}$ are held at a low so as to keep the heating members 312*a*–312*d* unheated when no toner image is brought close to the heating members 312*a*–312*d*. When toner image T1 is brought close to the heater 312, the signal $A_{int-d}$ is raised to a high to drive the corresponding heating member 312*d*. Thereby, the toner image T1 is heated and fixed on the recording sheet. The signal $A_{int-d}$ is then dropped to a low so as to deactivate the heating member 312*d* when the toner image T1 is brought away from the heating member 312*d* as the recording sheet P is being transferred in the fixing unit 311. During this operation, the signals $A_{int-a}$ and $A_{int-c}$ are not activated. Therefore, the fixing process for the toner image T1 is executed with a one-fourth the power consumption of a case in which a heating member having a width covering the whole sheet width is activated.

When toner image T2 is brought close to the heater 312, the signals $A_{int-c}$ and $A_{int-d}$ are raised to a high to drive the corresponding heating members 312*c* and 312*d*. Thereby, the toner image T2 is heated and fixed on the recording sheet P. The signals $A_{int-c}$ and $A_{int-d}$ are then dropped to a low so as to deactivate the heating members 312*c* and 312*d* when the toner image T2 is brought away from the heating members 312*c* and 312*d* as the recording sheet P is being transferred in the fixing unit 311. The remaining signals $A_{int-a}$ and $A_{int-b}$ are not activated during the above-described operation. Therefore, the fixing process for the toner image T2 is executed with one-half the power consumption of a case in which a heating member having a width covering the whole sheet width is activated.

When toner image T3 is brought close to the heater 312, the signals $A_{int-b}$ and $A_{int-c}$ are raised to a high to drive the corresponding heating members 312*b* and 312*c*. Thereby, the toner image T3 is heated and fixed on the recording sheet P. The signals $A_{int-b}$ and $A_{int-c}$ are then dropped to a low so as to deactivate the heating members 312*b* and 312*c* when the toner image T3 is brought away from the heating members 312*b* and 312*c* as the recording sheet P is being transferred in the fixing unit 311. The remaining signals $A_{int-a}$ and $A_{int-d}$ are not activated during the above operation. Therefore, the fixing process for the toner image T3 is executed with one-half the power consumption of a case in which a heating member having a width covering the whole sheet width is activated.

When toner image T4 is brought close to the heater 312, the signals $A_{int-b}$ and $A_{int-c}$, and $A_{int-d}$ are raised to a high to drive the corresponding heating members 312*b*, 312*c*, and 312*d* and thereby the toner image T4 is heated and fixed on the recording sheet P. The signals $A_{int-b}$, $A_{int-c}$, and $A_{int-d}$ are then dropped to a low so as to deactivate the heating members 312*b*, 312*c*, and 312*d* when the toner image T3 is brought away from the heating members 312*b*, 312*c*, and 312*d* as the recording sheet P is being transferred through the fixing unit 311. During this operation, the remaining signal $A_{int-a}$ is not activated. Therefore, the fixing process for the toner image T4 is executed with three-fourth the power consumption of a case in which a heating member having a width covering the whole sheet width is activated.

When toner image T5 is brought close to the heater 312, the signals $A_{int-a}$, $A_{int-b}$, $A_{int-c}$ and $A_{int-d}$ are raised to a high to drive the corresponding heating members 312*a*, 312*b*, 312*c*, and 312*d*. Thereby the toner image T5 is heated and fixed on the recording sheet P. The signals $A_{int-a}$, $A_{int-b}$, $A_{int-c}$ and $A_{int-d}$ are then dropped to a low so as to deactivate the heating members 312*a*, 312*b*, 312*c*, and 312*d* when the toner image T4 is brought away from the heating members 312*a*, 312*b*, 312*c*, and 312*d* as the recording sheet P is being transferred in the fixing unit 311. During this operation, all the signals $A_{int-a}$–$A_{int-d}$ are activated. Therefore, the fixing process for the toner image T5 is executed with full the power consumption of a case in which a heating member having a width covering the whole sheet width is activated.

During the above-described operations, the signals $A_{int-a}$ through to $A_{int-d}$ are not activated and the heating members 312*a* through to 312*d* of the heater 312 are not heated when a recording region having no toner image in the recording sheet P is brought to be passing by the heater 312.

Thus, the fixing unit 311 can greatly save the energy of electric power through its fixing operation, as described above. This would be readily understood by comparing it with a case where the heating members 312*a*–212*d* of the heater 312 are always driven with continuous driving signals. For example, a text image that has lines of characters typically includes spaces between the lines. When such an image is processed by the fixing unit 311, the signals $A_{int-a}$–$A_{int-d}$ are held at a low at which no energy is consumed during the time periods corresponding to these spaces. Thus, a great amount of electric power can be saved.

Figure 21:
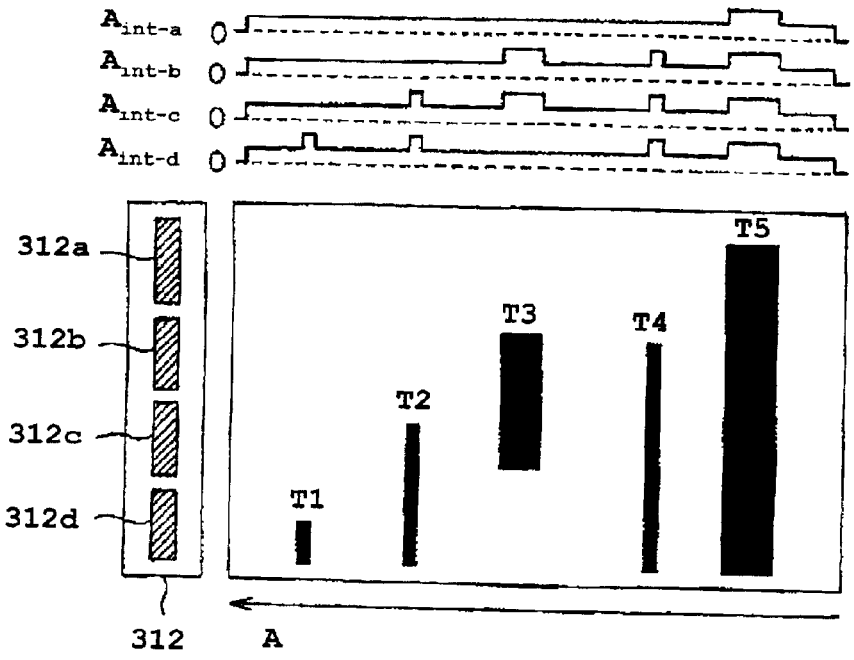
FIG. 21 is an illustration for explaining a modification of the fixing operation explained with reference to FIG. 20.

FIG. 21 shows a modification of the fixing power control performed by the fixing power control unit 323. As in the case of the fixing power control unit 23 of FIG. 3, each of the signals $A_{int-a}$ though to $A_{int-d}$ has three levels; a zero level, a white level, and a black level. The black level is a level in which a heating member of the heater 312 is driven in a full power. The white level is a level in which a heating member of the heater 312 is primarily heated with an electric power with a reduction of 5% or more from the power of the black level.

In this case, the toner images T1–T5 are different in size from each other, as shown in FIG. 21, as in the case of FIG. 20. During the time the recording sheet P is not present in the fixing unit 311, the signals $A_{int-a}$–$A_{int-d}$ are held at the zero level. Also, during the time a non-recording area of the recording sheet P is brought to be passing by the heater 312, the signals $A_{int-a}$–$A_{int-d}$ are held at the zero level. When the recording sheet P is present in the fixing unit 311 and a recording area of the recording sheet P is brought to be passing by the heater 312, the signals $A_{int-a}$–$A_{int-d}$ are held at the white level.

When toner image T1 is brought close to the heater 312, the signal $A_{int-d}$ is raised from the white level to the black level to drive the corresponding heating member 312*d*. The toner image T1 is thereby heated and fixed on the recording sheet P. The signal $A_{int-d}$ is then dropped to the white level so as to pre-heat the heating member 312*d* when the toner image T1 is brought away from the heating member 312*d* as the recording sheet P is being transferred through the fixing unit 311. The remaining signals $A_{int-a}$–$A_{int-c}$ are held at the white level during the above operation. Therefore, comparison with the power consumption of a case in which a heating member having a width covering the whole sheet width is activated, the fixing process for the toner image T1 is executed with the following reduced power consumption P1;

$$P1=(1/4)\times 1+(3/4)\times 0.95.$$

When toner image T2 is brought close to the heater 312, the signal $A_{int-c}$–$_{int-d}$ are raised to the black level to drive the corresponding heating member 312*c* and 312*d*. The toner image T2 is thereby heated and fixed on the recording sheet P. The signals $A_{int-c}$ and $A_{int-d}$ are then dropped to the white level so as to pre-heat the heating members 312*c* and 312*d* when the toner image T2 is brought away from the heating members 312*c* and 312*d* as the recording sheet P is being transferred in the fixing unit 311. During this operation, the remaining signals $A_{int-a}$ and $A_{int-b}$ are not activated. Therefore, the fixing process for the toner image T2 is executed with the following reduced power consumption P2;

$$P2=(1/2)\times 1+(1/2)\times 0.95.$$

When toner image T3 is brought close to the heater 312, the signals $A_{int-b}$ and $A_{int-c}$ are raised to the black level to drive the corresponding heating members 312*b* and 312*c*. The toner image T3 is thereby heated and fixed on the recording sheet P. The signals $A_{int-b}$ and $A_{int-c}$ are then dropped to the white level so as to pre-heat the heating members 312*b* and 312*c* when the toner image T3 is brought away from the heating members 312*b* and 312*c* as the recording sheet P is being transferred in the fixing unit 311. During this operation, the remaining signals $A_{int-a}$ and $A_{int-d}$ are not activated. Therefore, the fixing process for the toner image T3 is executed with the following reduced power consumption P3;

$$P3=(1/2)\times 1+(1/2)\times 0.95.$$

When toner image T4 is brought close to the heater 312, the signals $A_{int-b}$, $A_{int-c}$, and $A_{int-d}$ are raised to the black level to drive the corresponding heating members 312*b*, 312*c*, and 312*d*. Thereby, the toner image T4 is heated and fixed on the recording sheet P. The signals $A_{int-b}$, $A_{int-c}$ and $A_{int-d}$ are then dropped to the white level so as to pre-heat the heating member 312*b*, 312*c*, and 312*d* when the toner image T4 is brought away from the heating members 312*b*, 312*c*, and 312*d* as the recording sheet P is being transferred in the fixing unit 311. The remaining signal $A_{int-a}$ is not activated during the above-described operation. Therefore, the fixing process for the toner image T4 is executed with the following reduced power consumption P4;

$$P4=(3/4)\times 1+(1/4)\times 0.95.$$

When toner image T5 is brought close to the heater 312, the signals $A_{int-a}$, $A_{int-b}$, $A_{int-c}$ and $A_{int-d}$ are raised to the black level to drive the corresponding heating members 312*a*, 312*b*, 312*c*, and 312*d*. Thereby, the toner image T5 is heated and fixed on the recording sheet P. The signals $A_{int-a}$, $A_{int-b}$, $A_{int-c}$ and $A_{int-d}$ are then dropped to the white level so as to pre-heat the heating member 312*a*, 312*b*, 312*c*, and 312*d* when the toner image T4 is brought away from the heater 312 as the recording sheet P is being transferred through the fixing unit 311. During this operation, all the signal $A_{int-a}$–$A_{int-d}$ are activated and, in this case, the fixing process for the toner image T5 is executed with the power consumption same as that of a case in which a heating member having a width covering the whole sheet width is activated.

During the above-described operations, the signals $A_{int-a}$ through to $A_{int-d}$ are not activated and the heating members 312*a* through to 312*d* of the heater 312 are not heated when a recording region having no toner image in the recording sheet P is brought to be passing by the heater 312.

Thus, the fixing unit 311 can greatly save the energy of electric power through its fixing operation with the above-described modified fixing power control performed by the fixing power control unit 323. This would be readily understood by comparing it with a case where the heating members 312*a*–212*d* of the heater 312 are always driven with continuous driving signals. For example, a text image that has lines of characters typically includes spaces between the lines. When such an image is processed by the fixing unit 311, the signals $A_{int-a}$–$A_{int-d}$ are held at the white level at which an electric power reduction of 5% or more can be made during the time periods corresponding to these spaces. Thus, a great amount of electric power can be saved.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent applications, No. JPAP2000-249839 filed on Aug. 21, 2000, No. JPAP2000-365159 filed on Nov. 30, 2000, No. JPAP2000-274850 filed on Sep. 11, 2000, and No. JPAP2001-163025 filed on May 30, 2001 in the Japanese Patent Office, the entire contents of which are incorporated by reference herein.

What is claimed as new and is desired to be secured by Letters Patent of the United States is:

1. A fixing apparatus, comprising:

a heater extending in a direction orthogonal to a direction in which a same recording sheet carrying an unfixed toner image having at least two different sized toner images formed with toner in accordance with image information is transferred;

an endless belt configured to be rotated with an inner surface thereof sliding over a surface of said heater;

a pressure roller arranged at a position opposite to said heater relative to said endless belt, said pressure roller being held for rotation in contact with said endless belt under pressure to form a nip therebetween; and a heater controller configured to control the heater to produce a different amount of heat for corresponding different sized toner images on the same recording sheet in accordance with at least one of a size and a thickness of the different sized toner images on the same recording sheet, wherein, when said recording sheet is brought to said nip with said unfixed toner image facing said endless belt, said pressure roller applies pressure to said recording sheet against said endless belt so that said unfixed toner image is fixed on said recording sheet with heat by said heater as said recording sheet is transferred by movement of said endless belt and said pressure roller.

2. A fixing apparatus as defined in claim 1, wherein said toner includes a resin as a main adhesive agent and has properties of a softening or melting point in a range between 50° C. and 160° C. and a viscosity in a range between 10 (c poise) and $10^{13}$ (c poise) under a temperature above said softening or melting point.

3. A fixing apparatus as defined in claim 1, wherein said heater includes at least two parallel heating elements, each of which has a line shape orthogonal to said direction in which said recording sheet is transferred.

4. A fixing apparatus as defined in claim 3, wherein said heater controller alternately energizes said at least two parallel heating elements with alternating pulses.

5. A fixing apparatus as defined in claim 3, wherein said at least two parallel heating elements are distant from each other by 10 mm or less.

6. A fixing apparatus as defined in claim 3, wherein each of said at least two parallel heating elements has a width in a range between 0.01 mm and 5 mm.

7. A fixing apparatus as defined in claim 1, wherein said heater includes a plurality of heating elements arranged in line in a direction orthogonal to said direction in which said recording sheet is transferred.

8. A fixing apparatus as defined in claim 7, wherein each of said plurality of heating elements includes a thermal head.

9. A fixing apparatus as defined in claim 7, wherein said heater controller selectively energizes said plurality of heating elements.

10. A fixing apparatus as defined in claim 1, further comprising a cooling mechanism configured to cool said toner image after said toner image is fixed with heat by said heater on said recording sheet.

11. A fixing apparatus as defined in claim 1, further comprising a guide roller arranged at a position downstream from said heater in said direction in which said recording sheet is transferred, said guide roller being configured to support said endless belt and to serve as a cooling mechanism configured to cool said toner image after said toner image is fixed with heat by said heater on said recording sheet.

12. A fixing apparatus as defined in claim 1, further comprising a mechanism configured to cause said endless belt to tightly hold said toner image and said recording sheet together until said toner image is fixed on said recording sheet after said toner image is subjected to the heat of said heater.

13. A fixing apparatus as defined in claim 1, wherein said heater controller stops energizing said heater during a time when a non-image region between two adjacent toner image lines in said recording sheet is brought close to said heater.

14. A fixing apparatus as defined in claim 1, wherein said heater controller energizes said heater during a time when a region of said toner image in said recording sheet is brought close to said heater.

15. A fixing apparatus as defined in claim 1, wherein said heater controller energizes said heater with an electric power reduced by 5% or more during a time when a non-image region between two adjacent toner image lines in said recording sheet is brought close to said heater.

16. A fixing apparatus, comprising:

heating means for heating an unfixed toner image having at least two different sized toner images formed with toner on a same recording sheet in accordance with image information, said heating means extending in a direction orthogonal to a direction in which said recording sheet is transferred;

endless belt means for transferring the recording sheet and being rotated with an inner surface thereof sliding over a surface of said heating means;

pressure roller means for applying pressure to the heating means and being held for rotation in contact with said endless belt means under pressure to form a nip therebetween, said pressure roller means being arranged at a position opposite to said heating means relative to said endless belt means; and heater controlling means for controlling the heating means to produce a different amount of heat for corresponding different sized toner images on the same recording sheet in accordance with at least one of a size and a thickness of the different sized toner images on the same recording sheet, wherein, when said recording sheet is brought to said nip with said unfixed toner image facing said endless belt means, said pressure roller means applies pressure to said recording sheet against said endless belt means so that said unfixed toner image is fixed on said recording sheet with heat by said heating means as said recording sheet is transferred by movement of said endless belt means and said pressure roller means.

17. A fixing apparatus as defined in claim 16, wherein said toner includes a resin as a main adhesive agent and has properties of a softening or melting point in a range between 50° C. and 160° C. and a viscosity in a range between 10 (c poise) and $10^{13}$ (c poise) under a temperature above said softening or melting point.

18. A fixing apparatus as defined in claim 16, wherein said heating means includes at least two parallel heating elements, each of which has a line shape orthogonal to said direction in which said recording sheet is transferred.

19. A fixing apparatus as defined in claim 18, wherein said heater controlling means alternately energizes said at least two parallel heating elements with alternating pulses.

20. A fixing apparatus as defined in claim 18, wherein said at least two parallel heating elements are distant from each other by 10 mm or less.

21. A fixing apparatus as defined in claim 18, wherein each of said at least two parallel heating elements has a width in a range between 0.01 mm and 5 mm.

22. A fixing apparatus as defined in claim 16, wherein said heating means includes a plurality of heating elements arranged in line in a direction orthogonal to said direction in which said recording sheet is transferred.

23. A fixing apparatus as defined in claim 22, wherein each of said plurality of heating elements includes a thermal head.

24. A fixing apparatus as defined in claim 22, wherein said heater controlling means selectively energizes said plurality of heating elements.

25. A fixing apparatus as defined in claim 16, further comprising cooling means for cooling said toner image after said toner image is fixed with heat by said heating means on said recording sheet.

26. A fixing apparatus as defined in claim 16, further comprising guide roller means for supporting said endless belt means and serving as cooling means for cooling said toner image after said toner image is fixed with heat by said heating means on said recording sheet, said guide roller means being arranged at a position downstream from said heating means in said direction in which said recording sheet is transferred.

27. A fixing apparatus as defined in claim 16, further comprising means for causing said endless belt means to tightly hold said toner image and said recording sheet together until said toner image is fixed on said recording sheet after said toner image is subjected to the heat of said heating means.

28. A fixing apparatus as defined in claim 16, wherein said heater controlling means stops energizing said heating means during a time when a non-image region between two adjacent toner image lines in said recording sheet is brought close to said heating means.

29. A fixing apparatus as defined in claim 16, wherein said heater controlling means energizes said heating means during a time when a region of said toner image in said recording sheet is brought close to said heating means.

30. A fixing apparatus as defined in claim 16, wherein said heater controlling means energizes said heating means with an electric power reduced by 5% or more during a time when a non-image region between two adjacent toner image lines in said recording sheet is brought close to said heating means.

31. A fixing method of image forming, comprising the steps of:

forming a nip between an endless belt and a pressure roller which are held for rotation in contact with each other under pressure;

providing a heater at position inside said endless belt, in contact with said endless belt, and opposite to said pressure roller relative to said endless belt, said heater extending in a direction orthogonal to a direction in which a same recording sheet having an unfixed toner image having at least two different sized toner images formed with toner in accordance with image information is transferred;

rotating said endless belt and said pressure roller, said endless belt sliding over a surface of said heater by rotation;

transferring said recording sheet to said nip, said recording sheet being in an orientation in which said toner image faces said endless belt; and controlling the heater to produce a different amount of heat for corresponding different sized toner images on the same recording sheet in accordance with at least one of a size and a thickness of the different sized toner images on the same recording sheet when said toner image is brought to said heater.

32. A fixing method as defined in claim 31, wherein said toner includes a resin as a main adhesive agent and has properties of a softening or melting point in a range between 50° C. and 160° C. and a viscosity in a range between 10 (c poise) and $10^{13}$ (c poise) under a temperature above said softening or melting point.

33. A fixing method as defined in claim 31, wherein said heater includes at least two parallel heating elements, each of which has a line shape orthogonal to said direction in which said recording sheet is transferred.

34. A fixing method as defined in claim 33, wherein said controlling alternately energizes said at least two parallel heating elements with alternating pulses.

35. A fixing method as defined in claim 33, wherein said at least two parallel heating elements are distant from each other by 10 mm or less.

36. A fixing apparatus as defined in claim 33, wherein each of said at least two parallel heating elements has a width in a range between 0.01 mm and 5 mm.

37. A fixing method as defined in claim 31, wherein said heater includes a plurality of heating elements arranged in line in a direction orthogonal to said direction in which said recording sheet is transferred.

38. A fixing method as defined in claim 37, wherein each of said plurality of heating elements includes a thermal head.

39. A fixing method as defined in claim 37, wherein said controlling step selectively energizes said plurality of heating elements.

40. A fixing method as defined in claim 31, further comprising the step of cooling said toner image after said toner image is fixed with heat by said heater on said recording sheet.

41. A fixing method as defined in claim 31, further comprising the step of providing a guide roller for supporting said endless belt and for serving as a cooling member for cooling said toner image after said toner image is fixed with heat by said heater on said recording sheet, said guide roller being arranged at a position downstream from said heater in said direction in which said recording sheet is transferred.

42. A fixing method as defined in claim 31, further comprising the step of providing a member for causing said endless belt to tightly hold said toner image and said recording sheet together until said toner image is fixed on said recording sheet after said toner image is subjected to the heat of said heater.

43. A fixing method as defined in claim 31, wherein said controlling step stops energizing said heater during a time when a non-image region between two adjacent toner image lines in said recording sheet is brought close to said heater.

44. A fixing method as defined in claim 31, wherein said controlling step energizes said heater during a time when a region of said toner image in said recording sheet is brought close to said heater.

45. A fixing method as defined in claim 31, wherein said controlling step energizes said heater with an electric power reduced by 5% or more during a time when a non-image region between two adjacent toner image lines in said recording sheet is brought close to said heater.

46. An image forming apparatus, comprising:

an image forming mechanism configured to form a toner image having at least two different sized toner images with toner on a same recording sheet in accordance with image information;

a heater extending in a direction orthogonal to a direction in which said recording sheet carrying an unfixed toner image formed by said image forming mechanism is transferred;

an endless belt configured to be rotated with an inner surface thereof sliding over a surface of said heater;

a pressure roller arranged at a position opposite to said heater relative to said endless belt, said pressure roller being held for rotation in contact with said endless belt under pressure to form a nip therebetween; and a heater controller configured to control the heater to produce a different amount of heat for corresponding different sized toner images on the same recording sheet in accordance with at least one of a size and a thickness of the different sized toner images on the same recording sheet, wherein, when said recording sheet is brought to said nip with said unfixed toner image facing said endless belt, said pressure roller applies pressure to said recording sheet against said endless belt so that said unfixed toner image is fixed on said recording sheet with heat by said heater as said recording sheet is transferred by movement of said endless belt and said pressure roller.

47. An image forming apparatus as defined in claim 46, wherein said toner includes a resin as a main adhesive agent and has properties of a softening or melting point in a range between 50° C. and 160° C. and a viscosity in a range between 10 (c poise) and $10^{13}$ (c poise) under a temperature above said softening or melting point.

48. An image forming apparatus as defined in claim 46, wherein said heater includes at least two parallel heating elements, each of which has a line shape orthogonal to said direction in which said recording sheet is transferred.

49. An image forming apparatus as defined in claim 48, wherein said heater controller alternately energizes said at least two parallel heating elements with alternating pulses.

50. An image forming apparatus as defined in claim 48, wherein said at least two parallel heating elements are distant from each other by 10 mm or less.

51. An image forming apparatus as defined in claim 48, wherein each of said at least two parallel heating elements has a width in a range between 0.01 mm and 5 mm.

52. An image forming apparatus as defined in claim 46, wherein said heater includes a plurality of heating elements arranged in line in a direction orthogonal to said direction in which said recording sheet is transferred.

53. An image forming apparatus as defined in claim 52, wherein each of said plurality of heating elements includes a thermal head.

54. An image forming apparatus as defined in claim 52, wherein said heater controller selectively energizes said plurality of heating elements.

55. An image forming apparatus as defined in claim 46, further comprising a cooling mechanism configured to cool said toner image after said toner image is fixed with heat by said heater on said recording sheet.

56. An image forming apparatus as defined in claim 46, further comprising a guide roller arranged at a position downstream from said heater in said direction in which said recording sheet is transferred, said guide roller being configured to support said endless belt and to serve as a cooling mechanism configured to cool said toner image after said toner image is fixed with heat by said heater on said recording sheet.

57. An image forming apparatus as defined in claim 46, further comprising a mechanism configured to cause said endless belt to tightly hold said toner image and said recording sheet together until said toner image is fixed on said recording sheet after said toner image is subjected to the heat of said heater.

58. An image forming apparatus as defined in claim 46, wherein said heater controller stops energizing said heater during a time when a non-image region between two adjacent toner image lines in said recording sheet is brought close to said heater.

59. An image forming apparatus as defined in claim 46, wherein said heater controller energizes said heater during a time when a region of said toner image in said recording sheet is brought close to said heater.

60. An image forming apparatus as defined in claim 46, wherein said heater controller energizes said heater with an electric power reduced by 5% or more during a time when a non-image region between two adjacent toner image lines in said recording sheet is brought close to said heater.

61. An image forming apparatus, comprising:

image forming means for forming a toner image having at least two different sized toner images with toner on a recording sheet in accordance with image information;

heating means for heating an unfixed toner image formed with toner on a same recording sheet in accordance with image information, said heating means extending in a direction orthogonal to a direction in which said recording sheet is transferred;

endless belt means for transferring the recording sheet and being rotated with an inner surface thereof sliding over a surface of said heating means;

pressure roller means for applying pressure to the heating means being held for rotation in contact with said endless belt means under pressure to form a nip therebetween, said pressure roller means being arranged at a position opposite to said heating means relative to said endless belt means; and heater controlling means for controlling the heating means to produce a different amount of heat for corresponding different sized toner images on the same recording sheet in accordance with at least one of a size and a thickness of the different sized toner images on the same recording sheet, wherein, when said recording sheet is brought to said nip with said unfixed toner image facing said endless belt means, said pressure roller means applies pressure to said recording sheet against said endless belt means so that said unfixed toner image is fixed on said recording sheet with heat by said heating means as said recording sheet is transferred by movement of said endless belt means and said pressure roller means.

62. An image forming apparatus as defined in claim 61, wherein said toner includes a resin as a main adhesive agent and has properties of a softening or melting point in a range between 50° C. and 160° C. and a viscosity in a range between 10 (c poise) and $10^{13}$ (c poise) under a temperature above said softening or melting point.

63. An image forming apparatus as defined in claim 61, wherein said heating means includes at least two parallel heating elements, each of which has a line shape orthogonal to said direction in which said recording sheet is transferred.

64. An image forming apparatus as defined in claim 63, wherein said heater controlling means alternately energizes said at least two parallel heating elements with alternating pulses.

65. An image forming apparatus as defined in claim 63, wherein said at least two parallel heating elements are distant from each other by 10 mm or less.

66. An image forming apparatus as defined in claim 63, wherein each of said at least two parallel heating elements has a width in a range between 0.01 mm and 5 mm.

67. An image forming apparatus as defined in claim 61, wherein said heating means includes a plurality of heating elements arranged in line in a direction orthogonal to said direction in which said recording sheet is transferred.

68. An image forming apparatus as defined in claim 67, wherein each of said plurality of heating elements includes a thermal head.

69. An image forming apparatus as defined in claim 67, wherein said heater controlling means selectively energizes said plurality of heating elements.

70. An image forming apparatus as defined in claim 61, further comprising cooling means for cooling said toner image after said toner image is fixed with heat by said heating means on said recording sheet.

71. An image forming apparatus as defined in claim 61, further comprising guide roller means for supporting said endless belt means and serving as cooling means for cooling said toner image after said toner image is fixed with heat by said heating means on said recording sheet, said guide roller means being arranged at a position downstream from said heating means in said direction in which said recording sheet is transferred.

72. An image forming apparatus as defined in claim 61, further comprising means for causing said endless belt means to tightly hold said toner image and said recording sheet together until said toner image is fixed on said recording sheet after said toner image is subjected to the heat of said heating means.

73. An image forming apparatus as defined in claim 61, wherein said heater controlling means stops energizing said heating means during a time when a non-image region between two adjacent toner image lines in said recording sheet is brought close to said heating means.

74. An image forming apparatus as defined in claim 61, wherein said heater controlling means energizes said heating means during a time when a region of said toner image in said recording sheet is brought close to said heating means.

75. An image forming apparatus as defined in claim 61, wherein said heater controlling means energizes said heating means with an electric power reduced by 5% or more during a time when a non-image region between two adjacent toner image lines in said recording sheet is brought close to said heating means.

* * * * *